US011864621B2

(12) United States Patent
Cooper

(10) Patent No.: US 11,864,621 B2
(45) Date of Patent: Jan. 9, 2024

(54) SOLE STRUCTURE HAVING DIFFERING HARDNESS REGIONS

(71) Applicant: NIKE, Inc., Beaverton, OR (US)

(72) Inventor: Aaron A C Cooper, Portland, OR (US)

(73) Assignee: Nike, Inc., Beaverton, OR (US)

( * ) Notice: Subject to any disclaimer, the term of this patent is extended or adjusted under 35 U.S.C. 154(b) by 237 days.

(21) Appl. No.: 17/419,961

(22) PCT Filed: Dec. 27, 2019

(86) PCT No.: PCT/US2019/068661
§ 371 (c)(1),
(2) Date: Jun. 30, 2021

(87) PCT Pub. No.: WO2020/142355
PCT Pub. Date: Jul. 9, 2020

(65) Prior Publication Data

US 2022/0079284 A1 Mar. 17, 2022

Related U.S. Application Data

(60) Provisional application No. 62/786,685, filed on Dec. 31, 2018.

(51) Int. Cl.
*A43B 13/12* (2006.01)

(52) U.S. Cl.
CPC ..... *A43B 13/122* (2013.01)

(58) Field of Classification Search
CPC ..... A43B 13/122; A43B 13/12; A43B 3/0073; A43B 13/188
See application file for complete search history.

(56) References Cited

U.S. PATENT DOCUMENTS 4,694,591 A * 9/1987 Banich ..... A43B 13/181 36/31
4,897,936 A * 2/1990 Fuerst ..... A43B 13/223 36/31

(Continued)

FOREIGN PATENT DOCUMENTS

| | | | |
|---|---|---|---|
| CN | 107006931 | A | 8/2017 |
| EP | 2353425 | A1 | 8/2011 |
| JP | H05329005 | A | 12/1993 |

OTHER PUBLICATIONS

EP Office Action in corresponding Application No. 19842549.8, dated Mar. 31, 2022, (7 pages).

(Continued)

*Primary Examiner* — Bao-Thieu L Nguyen
(74) *Attorney, Agent, or Firm* — Bookoff McAndrews, PLLC

(57) ABSTRACT

A sole structure of an article of footwear includes a first outer region, a second outer region, and a third outer region. The first outer region is at least partially disposed a first distance from a longitudinal axis and includes a first hardness. The second outer region is at least partially disposed a second distance from the longitudinal axis and includes a second hardness that is greater than the first hardness. The third outer region is at least partially disposed between the first outer region and the second outer region a third distance from the longitudinal axis and includes a third hardness that is greater than the first hardness and less than the second hardness. The second distance is greater than the first distance, and the third distance is greater than the first distance and less than the second distance.

19 Claims, 17 Drawing Sheets

(56) References Cited

U.S. PATENT DOCUMENTS 4,930,232 A * 6/1990 Engle ..... A43B 17/14 36/71
5,815,949 A * 10/1998 Sessa ..... A43B 7/081 36/28
6,038,790 A * 3/2000 Pyle ..... A43B 7/144 36/28
6,079,125 A * 6/2000 Quellais ..... A43B 13/12 36/114
6,508,017 B1 * 1/2003 DeBarro ..... A43B 7/144 36/31
6,931,768 B2 * 8/2005 Baek ..... A43B 7/1425 36/25 R
7,096,605 B1 * 8/2006 Kozo ..... A43B 7/26 36/76 R
2003/0101620 A1 * 6/2003 Reed ..... B29D 35/10 36/43
2009/0056172 A1 3/2009 Cho
2010/0011622 A1 * 1/2010 Abadjian ..... A43B 13/223 36/114
2010/0071232 A1 3/2010 Steele
2011/0030245 A1 * 2/2011 Truelsen ..... A43B 13/12 36/76 R
2011/0283560 A1 * 11/2011 Portzline ..... A43B 13/186 36/31
2011/0302809 A1 * 12/2011 Kim ..... A43B 13/187 36/103
2012/0023781 A1 * 2/2012 Dojan ..... A43B 13/122 36/103
2012/0198728 A1 * 8/2012 Farrelly ..... A43B 13/16 36/25 R
2014/0259801 A1 * 9/2014 Grondin ..... A43B 1/0027 264/48
2014/0290097 A1 * 10/2014 Bann ..... B29D 35/142 36/102
2015/0082668 A1 * 3/2015 Nonogawa ..... A43B 7/144 36/30 R
2015/0282561 A1 * 10/2015 Swager Van Dok ..... A43B 13/127 36/31
2016/0021972 A1 * 1/2016 Grelle ..... A43B 7/24 36/140
2016/0324264 A1 * 11/2016 Johnson ..... A43B 3/244
2016/0345668 A1 * 12/2016 Dyer ..... A43B 13/186
2018/0160771 A1 * 6/2018 Clifton ..... A43B 13/122
2018/0168282 A1 * 6/2018 Tanaka ..... A43B 7/142
2018/0242685 A1 * 8/2018 Jackinsky ..... A43B 7/144
2020/0093223 A1 * 3/2020 Iuchi ..... A43B 13/181
2020/0305545 A1 * 10/2020 Yahata ..... A43B 7/1435

OTHER PUBLICATIONS

International Search Report and Written Opinion for Application PCT/US2019/068661 dated Mar. 31, 2020.
CN Office Action in corresponding Application No. 201980092276.8, dated Mar. 21, 2022, (5 pages).

* cited by examiner

SOLE STRUCTURE HAVING DIFFERING HARDNESS REGIONS

CROSS REFERENCE TO RELATED APPLICATIONS

The present application is a 371 National Stage entry based on International Application No. PCT/US2019/068661, filed Dec. 27, 2019 which claims priority to U.S. Provisional Patent Application No. 62/786,685, filed Dec. 31, 2018, the disclosures of which are hereby incorporated by reference in their entirety.

FIELD

The present disclosure relates generally to articles of footwear and more particularly to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. Laces, straps, or other fasteners may cooperate with the upper to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. Another layer of the sole structure includes a midsole disposed between the outsole and the upper. Sole structures may also include a comfort-enhancing insole and/or a sock-liner located within a void proximate to the bottom portion of the upper.

The outsole may be formed from rubber, composite, or other materials that impart durability and wear-resistance, as well as enhance stability and traction with the ground surface. The midsole provides cushioning for the foot and compresses resiliently under an applied load, such as during walking or running movements, to cushion the foot by attenuating ground-reaction forces. The midsole may define a bottom surface on one side that opposes the outsole and a footbed on the opposite side that may be contoured to conform to a profile of the bottom surface of the foot. Generally, midsoles are designed with an emphasis on balancing cushioning characteristics that relate to softness and responsiveness as the midsole compresses under gradient loads.

While traditional sole structures are suitable for providing durability, wear-resistance, traction, stability and cushioning, improvements to sole structures are continuously being sought in order to advance the arts.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
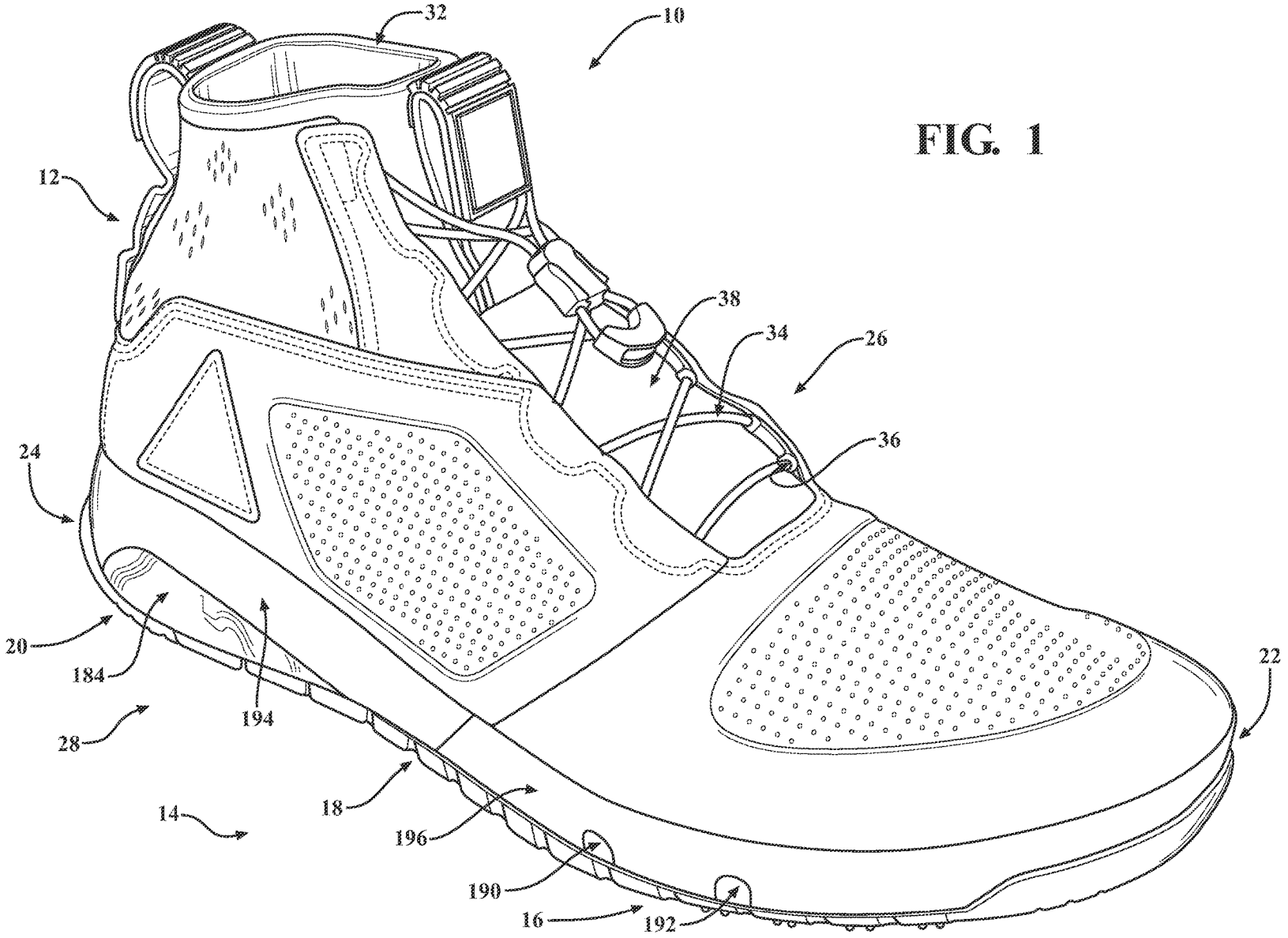
FIG. 1 is a perspective view of an article of footwear incorporating a sole structure in accordance with the principles of the present disclosure.
Figure 2:
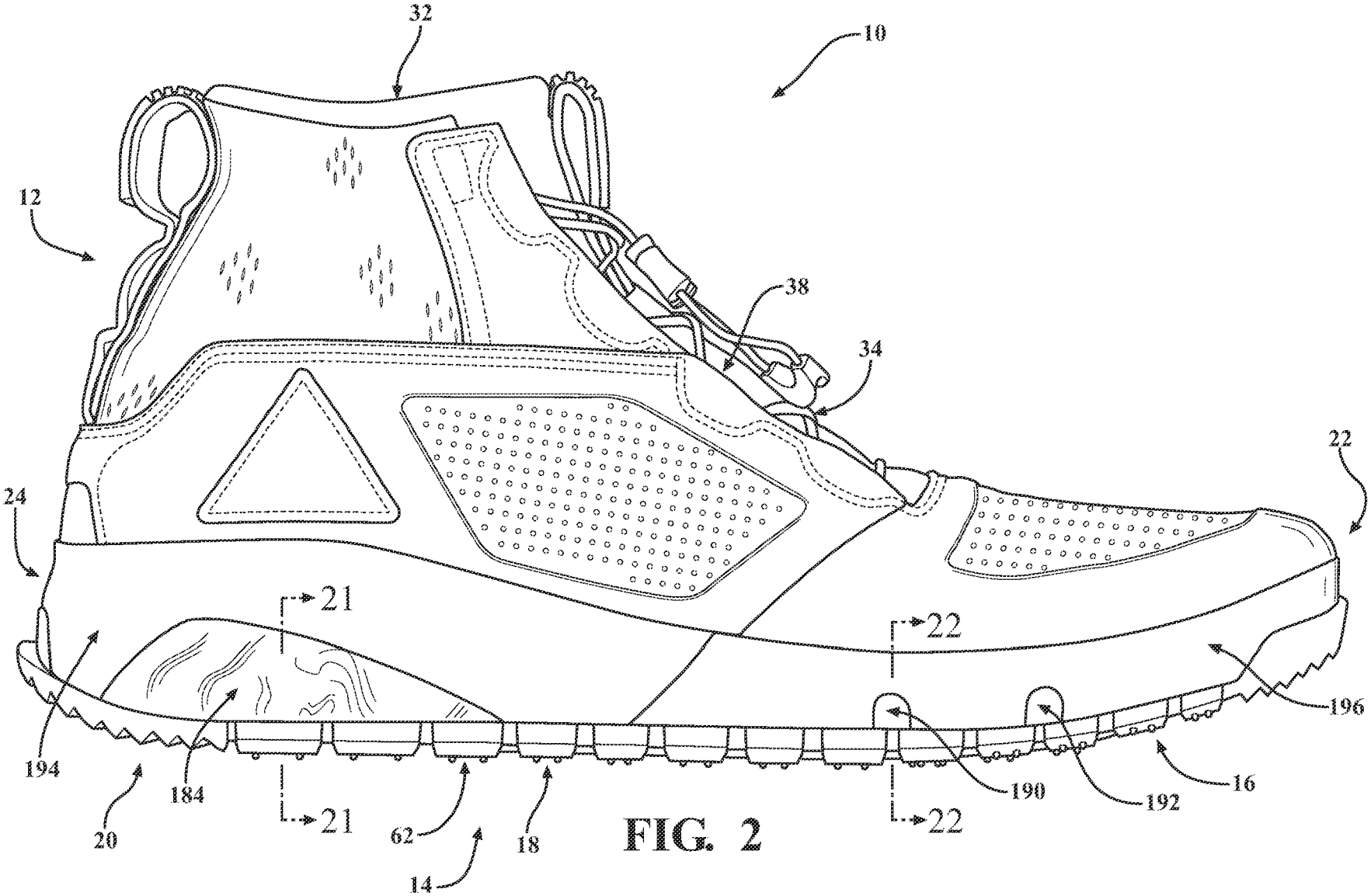
FIG. 2 is a lateral side view of the article of footwear of FIG. 1.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a sole structure for an article of footwear is provided. The sole structure includes a first outer region, a second outer region, and a third outer region. The first outer region is at least partially disposed a first distance from a longitudinal axis and includes a first hardness. The second outer region is at least partially disposed a second distance from the longitudinal axis and includes a second hardness that is greater than the first hardness. The third outer region is at least partially disposed between the first outer region and the second outer region a third distance from the longitudinal axis and includes a third hardness that is greater than the first hardness and less than the second hardness. The second distance is greater than the first distance, and the third distance is greater than the first distance and less than the second distance.

In some implementations, the first distance, the second distance, and the third distance extend away from a longitudinal axis of the sole structure toward a medial side or a lateral side of the sole structure.

In some implementations, the first outer region is an inner-most outer region and the second outer region is an outer-most outer region.

In some implementations, the first outer region, the second outer region and the third outer region are each formed from a different material. The first outer region may include a first material having the first hardness. The second outer region may include a second material having the second hardness. The third outer region may include a third material having the third hardness.

In some implementations, the first hardness includes a Shore A durometer value greater than 48 and less than 54. The third hardness may include a Shore A durometer value greater than 64 and less than 70. The second hardness may include a Shore A durometer value greater than 85 and less than 91.

In some implementations, the sole structure includes an outsole and a midsole. The outsole may include the second outer region and the third outer region and may define a first passage. The midsole may include a first outer pad disposed within the first passage. The first outer pad may include the first outer region. The first passage may be disposed within a heel region of the sole structure. The sole structure may further include a second passage disposed within one of a forefoot region or a midfoot region of the sole structure. The midsole may include a second outer pad disposed within the second passage.

In some implementations, the outsole includes an outsole base layer and an outsole insert layer. The outsole base layer may include the second outer region and at least one opening. The outsole insert layer may include the third outer region and at least one opening. The at least one opening of the outsole base layer is aligned with the at least one opening of the outsole insert layer. In some implementations, the midsole includes a first material having the first hardness, the outsole base layer includes a second material having the second hardness, and the outsole insert layer includes a third material having the third hardness. The outsole insert layer may include an intermediate portion, a ring portion, and a forked portion. The ring portion may extend from the intermediate portion and define the first passage. The forked portion may extend from the intermediate portion and define a second passage. In some implementations, the forked portion includes a lateral prong and a medial prong.

In some implementations, the midsole includes a midsole base layer and a midsole perimeter portion. The midsole base layer may include an upper surface and a lower surface. The midsole perimeter portion may be connected to the upper surface of the midsole base layer. The first outer pad may extend from the lower surface of the midsole base layer and through the first passage of the outsole. In some implementations, the midsole base layer includes a first material having the first hardness, and the outsole includes an outsole base layer and an outsole insert layer. The outsole base layer may include the second outer region including a second material having the third hardness. The outsole insert layer may include the third outer region including a third material having the third hardness.

In some implementations, the midsole includes a midsole heel band and a midsole forefoot band. The midsole heel band may be secured to at least one of the midsole base layer or the midsole perimeter portion. The midsole forefoot band may be secured to at least one of the midsole base layer or the midsole perimeter portion. In some implementations, the midsole base layer includes at least one heel region flange having at least one heel region embossed portion. The midsole perimeter portion may include at least one heel region passage sized for receiving the at least one heel region embossed portion. In some implementations, the midsole heel band includes at least one heel region opening. The at least one heel region embossed portion may extend through the at least one heel region passage and into the at least one heel region opening. In some implementations, the midsole base layer includes at least one forefoot region flange having at least one forefoot region embossed portion. The midsole perimeter portion may include at least one forefoot region passage sized for receiving the at least one forefoot region embossed portion. In some implementations, the midsole forefoot band includes at least one forefoot region opening. The at least one forefoot region embossed portion may extend through the at least one forefoot region passage and into the at least one forefoot region opening.

According to another aspect of the present disclosure, a sole structure for an article of footwear is provided. The sole structure includes an innermost outer region, an outermost outer region, and an intermediate outer region. The innermost outer region may be at least partially disposed along a longitudinal axis of the sole structure and include a first hardness. The outermost outer region may include a first outermost portion disposed along a lateral side of the sole structure, and a second outermost portion disposed along a medial side of the sole structure. The outermost outer region may include a second hardness that is greater than the first hardness. The intermediate outer region may include a first intermediate portion and a second intermediate portion. The first intermediate portion may be disposed between the innermost outer region and the first outermost portion. The second intermediate outer portion may be disposed between the innermost outer region and the second outermost portion. The intermediate outer region may include a third hardness that is greater than the first hardness and less than the second hardness.

In some implementations, the innermost outer region, the outermost outer region and the intermediate outer region are each formed from a different material.

In some implementations, the innermost outer region includes a first material having the first hardness, the outermost outer region includes a second material having the second hardness, and the intermediate outer region includes a third material having the third hardness.

The first hardness may include a Shore A durometer value greater than 48 and less than 54. The second hardness may include a Shore A durometer value greater than 85 and less than 91. The third hardness may include a Shore A durometer value greater than 64 and less than 70.

In some implementations, the sole structure includes an outsole and a midsole. The outsole may include the intermediate outer region and the outermost outer region and may define a first passage. The midsole may include a first outer pad disposed within the first passage. The first outer pad may include the innermost outer region. In some implementations, the first passage is disposed within a heel region of the sole structure. The sole structure may further include a second passage disposed within one of a forefoot region or a midfoot region of the sole structure. The midsole may include a second outer pad disposed within the second passage. In some implementations, the outsole includes an outsole base layer and an outsole insert layer. The outsole base layer may include the outermost outer region and at least one opening. The outsole insert layer may include the intermediate outer region and at least one opening. The at least one opening of the outsole base layer may be aligned with the at least one opening of the outsole insert layer. In some implementations, the midsole includes a first material having the first hardness. The outsole base layer may include a second material having the second hardness. The outsole insert layer may include a third material having the third hardness.

In some implementations, the outsole insert layer includes an intermediate portion, a ring portion, and a forked portion. The ring portion may extend from the intermediate portion and may define the first passage. The forked portion may extend from the intermediate portion and define a second passage. The forked portion may include a lateral prong and a medial prong.

In some implementations, the midsole includes a midsole base layer and a midsole perimeter portion. The midsole base layer may include an upper surface and a lower surface. The midsole perimeter portion may be connected to the upper surface of the midsole base layer. The first outer pad may extend from the lower surface of the midsole base layer and through the first passage of the outsole. The midsole base layer may include a first material having the first hardness. The outsole may include an outsole base layer and an outsole insert layer. The outsole base layer may include the outermost outer region including a second material having the second hardness. The outsole insert layer may include the intermediate outer region including a third material having the third hardness.

In some implementations, the midsole includes a midsole heel band and a midsole forefoot band. The midsole heel band may be secured to at least one of the midsole base layer or the midsole perimeter portion. The midsole forefoot band may be secured to at least one of the midsole base layer or the midsole perimeter portion. The midsole base layer may include at least one heel region flange having at least one heel region embossed portion. The midsole perimeter portion may include at least one heel region passage sized for receiving the at least one heel region embossed portion. The midsole heel band may include at least one heel region opening. The at least one heel region embossed portion may extend through the at least one heel region passage and into the at least one heel region opening.

In some implementations, the midsole base layer includes at least one forefoot region flange having at least one forefoot region embossed portion. The midsole perimeter portion may include at least one forefoot region passage sized for receiving the at least one forefoot region embossed portion. The midsole forefoot band may include at least one forefoot region opening. The at least one forefoot region embossed portion may extend through the at least one forefoot region passage and into the at least one forefoot region opening.

With reference to FIGS. 1-4, an article of footwear 10 is provided and includes an upper 12 and a sole structure 14 attached to the upper 12. The article of footwear 10 may be divided into one or more regions. The regions may include a forefoot region 16, a midfoot region 18, and a heel region 20. The forefoot region 16 may correspond with toes and joints connecting metatarsal bones with phalanx bones of a foot, and may include an anterior end 22 of the article of footwear 10. The midfoot region 18 may correspond with an arch area of the foot while the heel region 20 may correspond with rear portions of the foot, including a calcaneus bone, and may include a posterior end 24 of the article of footwear 10. The article of footwear 10 may additionally include a medial side 26 and a lateral side 28 that correspond with opposite sides of the article of footwear 10 and extend through the regions 16, 18, 20.

Figure 21:
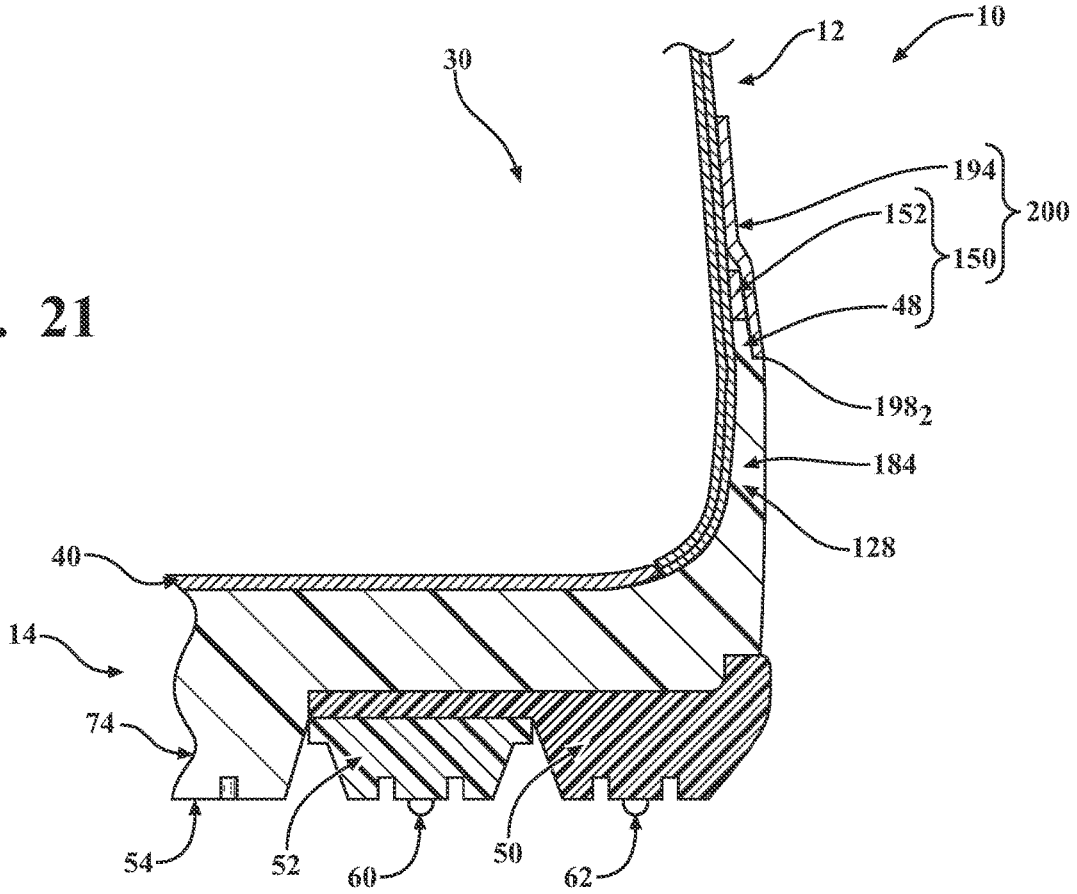
FIG. 21 is a cross-sectional view of the article of footwear of FIG. 1 taken along Line 21-21 of FIG. 2.
Figure 22:
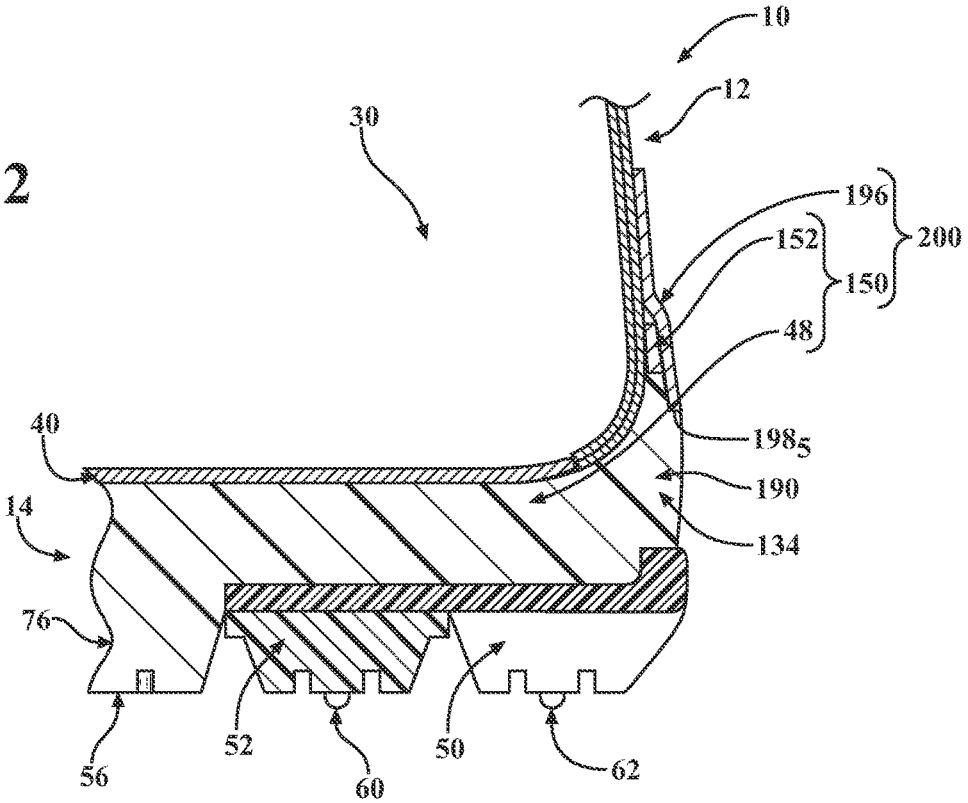
FIG. 22 is a cross-sectional view of the article of footwear of FIG. 1 taken along Line 22-22 of FIG. 2.

The upper 12 includes interior surfaces that define an interior void 30 (see FIGS. 21-22) that receives and secures a foot for support on the sole structure 14. An ankle opening 32 in the heel region 20 may provide access to the interior void 30. For example, the ankle opening 32 may receive a foot to secure the foot within the void 30 and facilitate entry and removal of the foot from and to the interior void 30. In some examples, one or more fasteners 34 extend along the upper 12 to adjust a fit of the upper 12 around the foot while concurrently accommodating entry and removal of the foot therefrom. The upper 12 may include apertures 36 such as eyelets and/or other engagement features such as fabric or mesh loops that receive the fasteners 34. The fasteners 34 may include laces, straps, cords, hook-and-loop, or any other suitable type of fastener. The upper 12 may additionally include a tongue portion 38 that extends between the interior void 30 and the fasteners 34.

Optionally, the upper 12 may include a strobel 40 (see FIGS. 3-4 and 21-22) configured to enclose a bottom portion of the interior void 30. The strobel 40 may be joined to the upper 12 using stitching. In some examples, the strobel 40 may additionally or alternatively be adhesively bonded to the upper 12, and may include multiple layers of material.

The upper 12 may be formed from one or more materials that are stitched or adhesively bonded together to form the interior void 30. Suitable materials of the upper 12 may include, textiles, foam, leather, and synthetic leather. The materials may be selected and located to impart properties of durability, air-permeability, wear-resistance, flexibility, and comfort to the foot while disposed within the interior void 30.

The sole structure 14 is attached to the upper 12 and provides the article of footwear 10 with support and cushioning during use. Namely, the sole structure 14 attenuates ground-reaction forces caused by the article of footwear 10 striking the ground during use. Accordingly, and as set forth below, the sole structure 14 may incorporate one or more materials having energy absorbing characteristics to allow the sole structure 14 to minimize the impact experienced by a user when wearing the article of footwear 10. Additionally, the sole structure 14 is configured to mitigate thermal transfer from a ground-covering surface to the foot of a user, as set forth below.

Figure 4:
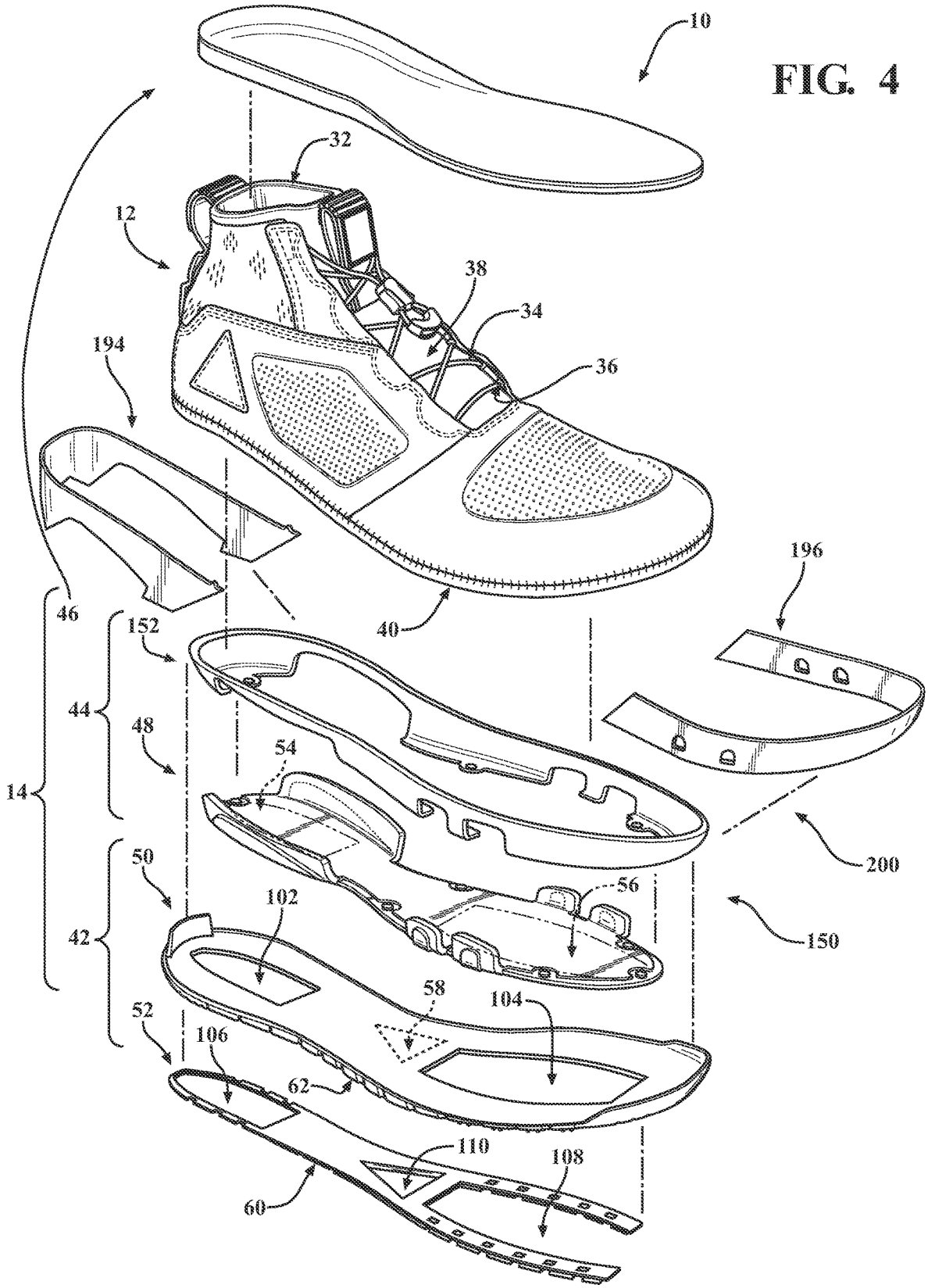
FIG. 4 is an exploded perspective view of the article of footwear of FIG. 1.

Referring to FIG. 4, the sole structure 14 may include different layers, such as, for example, an outsole 42, a midsole 44 and an optional sockliner or insole 46. Each layer may serve a particular function. For example, the insole 46 may be designed to contact the foot to provide enhanced comfort to the foot, as described above. In this regard, the insole 46 may be disposed within the interior void 30. In an example when the upper 12 includes the strobel 40, the insole 46 is formed separately from the midsole 44, and is disposed on an opposite side of the strobel 40 from the midsole 44. In other examples, where the upper 12 does not include the strobel 40, the insole 46 may include a layer formed into the sole structure 14 such that the insole 46 is disposed adjacent to the midsole 44 in an assembled configuration. A material, or combination of materials, of the insole 46 may be selected to impart properties of cushioning, stability, ventilation, and breathability.

With reference to FIG. 4, in a first configuration, the midsole 44 includes a midsole base layer 48. In another configuration, the midsole 44 may also include an optional midsole assembly 150 having an optional midsole perimeter portion 152 that is secured to the midsole base layer 48 (see also FIGS. 14 and 16). In yet another optional configuration, the midsole 44 may include the midsole base layer 48 secured to the optional midsole perimeter portion 152 for forming the optional midsole assembly 150 and an optional trimmed midsole assembly 200 (see also FIGS. 21-22) including one or more optional trim bands 194-196 (see also FIGS. 17-20) including, for example, one or both of a heel region trim band 194 and a forefoot region trim band 196.

With continued reference to FIG. 4, the outsole 42 includes an outsole base layer 50 and an outsole insert layer 52 disposed adjacent the outsole base layer 50. As will be described in the following disclosure, each of the outsole base layer 50 and the outsole insert layer 52 includes at least one opening 102-108 (see also FIGS. 9-10 and 12) that is sized for receiving and permitting passage of at least one portion (see, e.g., first and second ground-facing or ground-contact pads 74, 76 in FIGS. 7-8) of the midsole base layer 48. Accordingly, as seen in FIGS. 3-5 and 5A, the midsole base layer 48 (see, e.g., ground-facing or ground-contacting regions 54, 56 formed respectively by the first and second ground-facing or ground-contact pads 74, 76), the outsole base layer 50 (see, e.g., ground-facing or ground-contacting regions 58, 62) and the outsole insert layer 52 (see, e.g., ground-facing or ground-contacting region 60) may include a plurality of ground-facing or ground-contacting regions 54-62.

As will be described in the following disclosure, the midsole base layer 48, the outsole base layer 50, and the outsole insert layer 52 each include a material having a different hardness. Accordingly, because each of the midsole base layer 48, the outsole base layer 50, and the outsole insert layer 52 includes different outer regions 54, 56, 58 60, 62 of the sole structure 14, the outer regions 54, 56, 58 60, 62 may each include differing hardness regions of the sole structure 14. In an example, the plurality of outer regions 54-62 may include at least a first outer region formed from a soft material and a second outer region formed from a harder material. Accordingly, the differing hardness regions results in the sole structure 14 reacting differently when engaged with or disposed adjacent an underlying ground surface. In an example, one or more softer material regions of the sole structure 14 may conform to the underlying ground surface while one or more harder material regions of the sole structure 14 may resist conforming to the underlying ground surface. As will be described in more detail below, the outer regions 54-62 may form ground-facing or ground-contacting regions of the outsole 42 during use of the article of footwear 10. Accordingly, the outer regions 54-62 may also be referred to herein as ground-facing regions 54-62 or ground-contacting regions 54-62.

Figure 7:
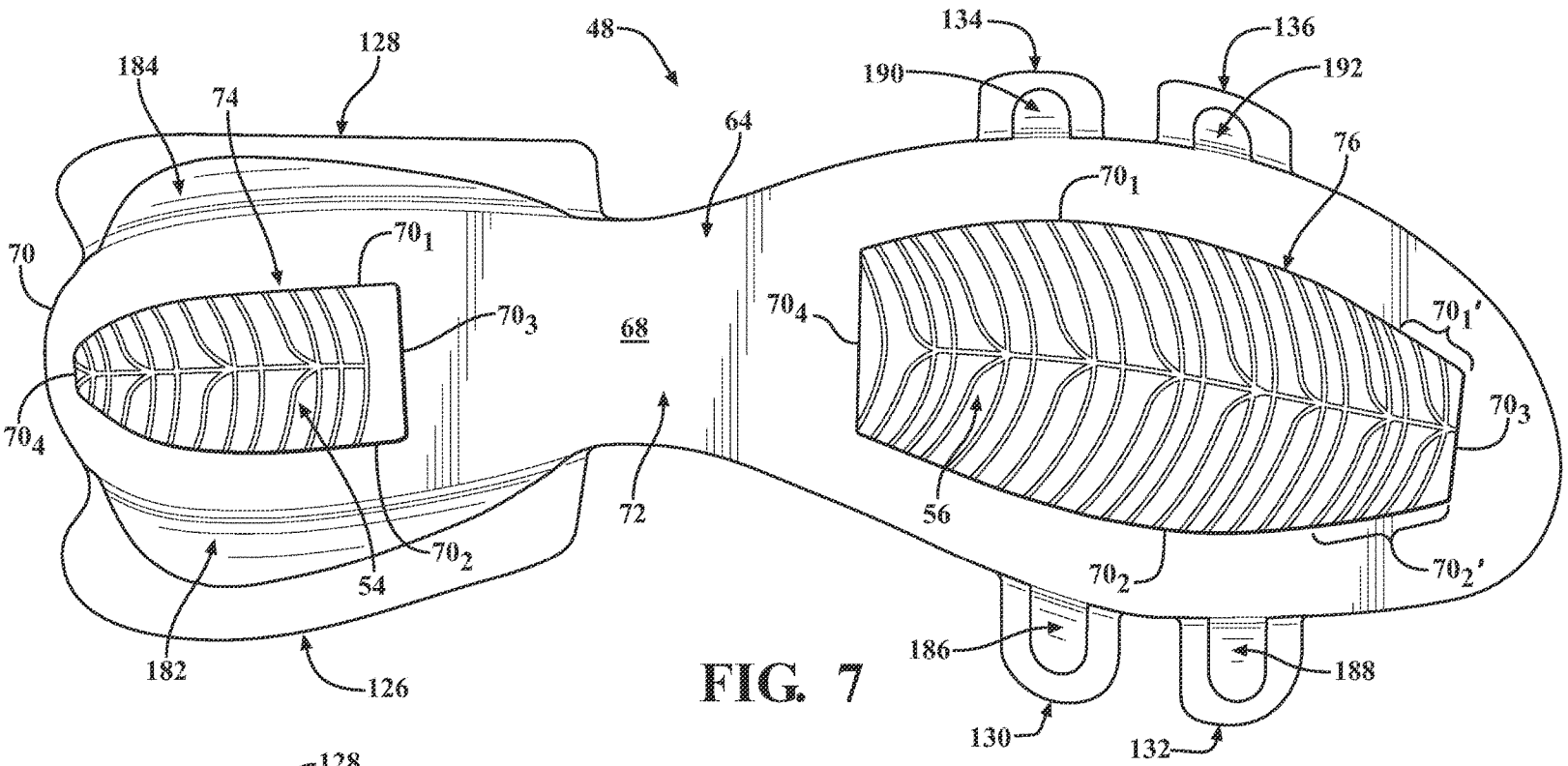
FIG. 7 is a bottom view of the midsole base layer of FIG. 6
Figure 9:
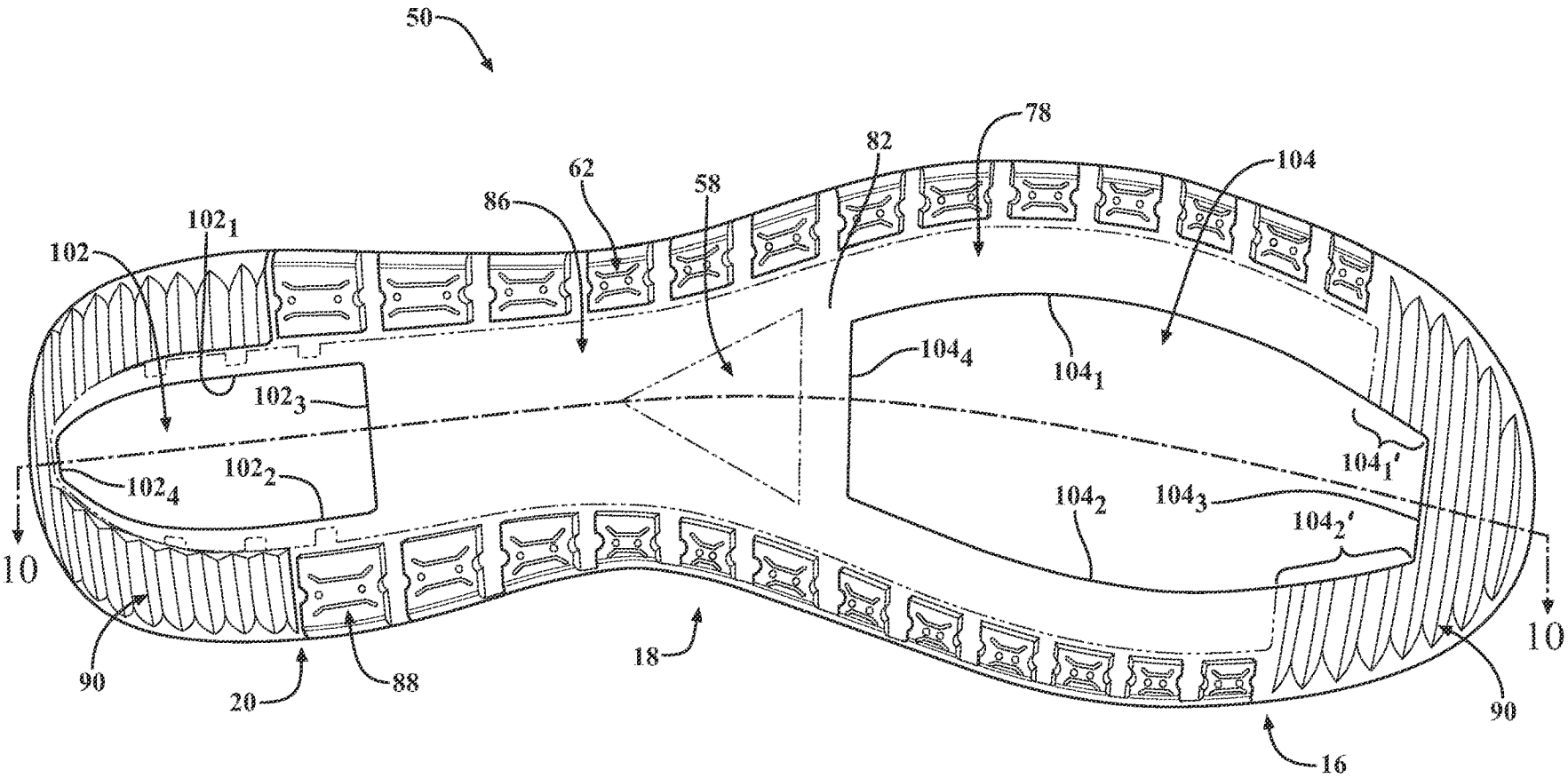
FIG. 9 is a bottom view of an outsole base layer of the article of footwear of FIG. 1.
Figure 12:
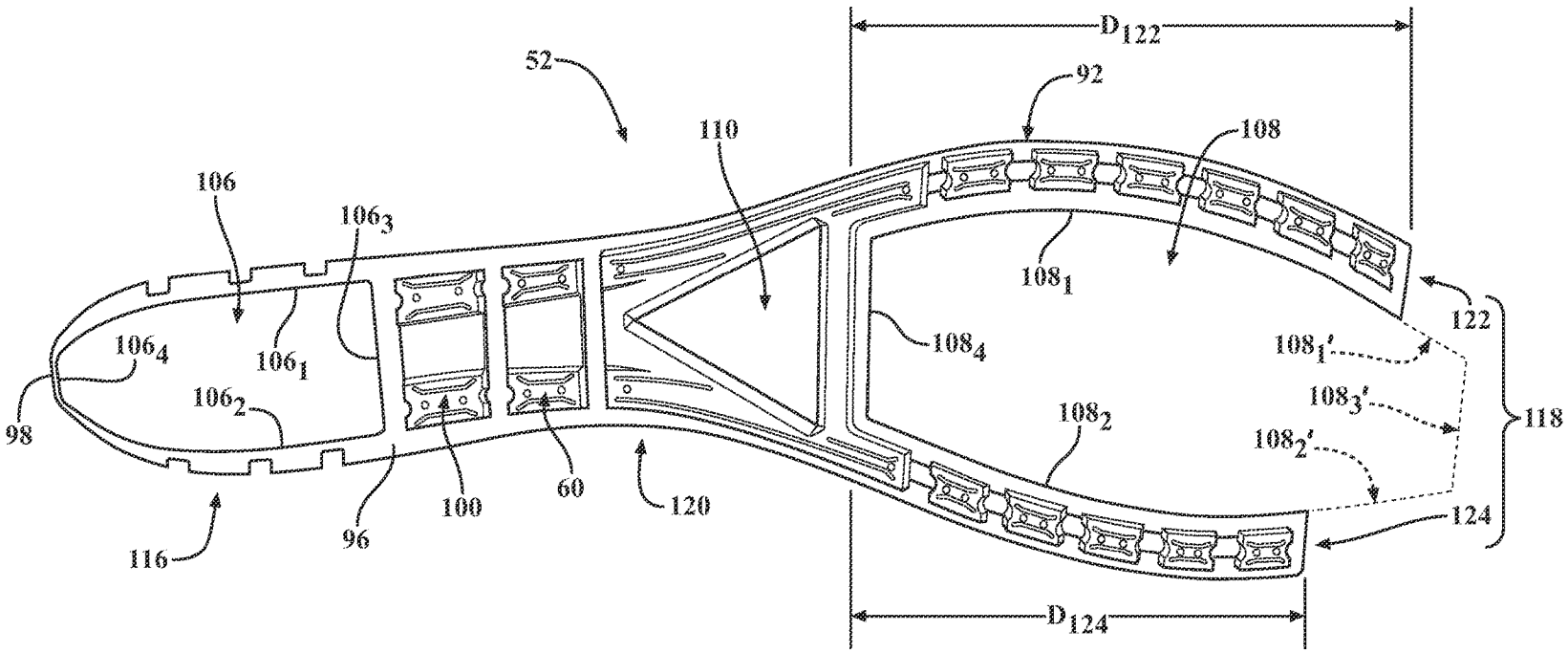
FIG. 12 is a bottom view of an outsole insert layer of the article of footwear of FIG. 1.

Furthermore, as seen at FIGS. 7, 9 and 12, the plurality of ground-facing or ground-contacting regions 54-62 may be selectively-shaped to include one or more thicknesses, widths, lengths, recesses, and the like. Accordingly, a selected hardness of a material in combination with a selected shape of each ground-facing or ground-contacting region of the plurality of outer regions 54-62 may contribute to each ground-facing or ground-contacting region of the plurality of ground-facing or ground-contacting regions 54-62 having differing grip, traction, and flexibility characteristics. The differing grip, traction, and flexibility characteristics of the sole structure 14 permits the article of footwear 10 to be adaptively utilized in more than one sporting activity whereby each sporting activity may be associated with a particular terrain or underlying ground surface. Accordingly, the sole structure 14 may be adaptively utilized in a number of sporting activities including but not limited to, for example: walking, running, biking, hiking, rock climbing, ball games (e.g., soccer, football, baseball) or the like.

Figure 5:
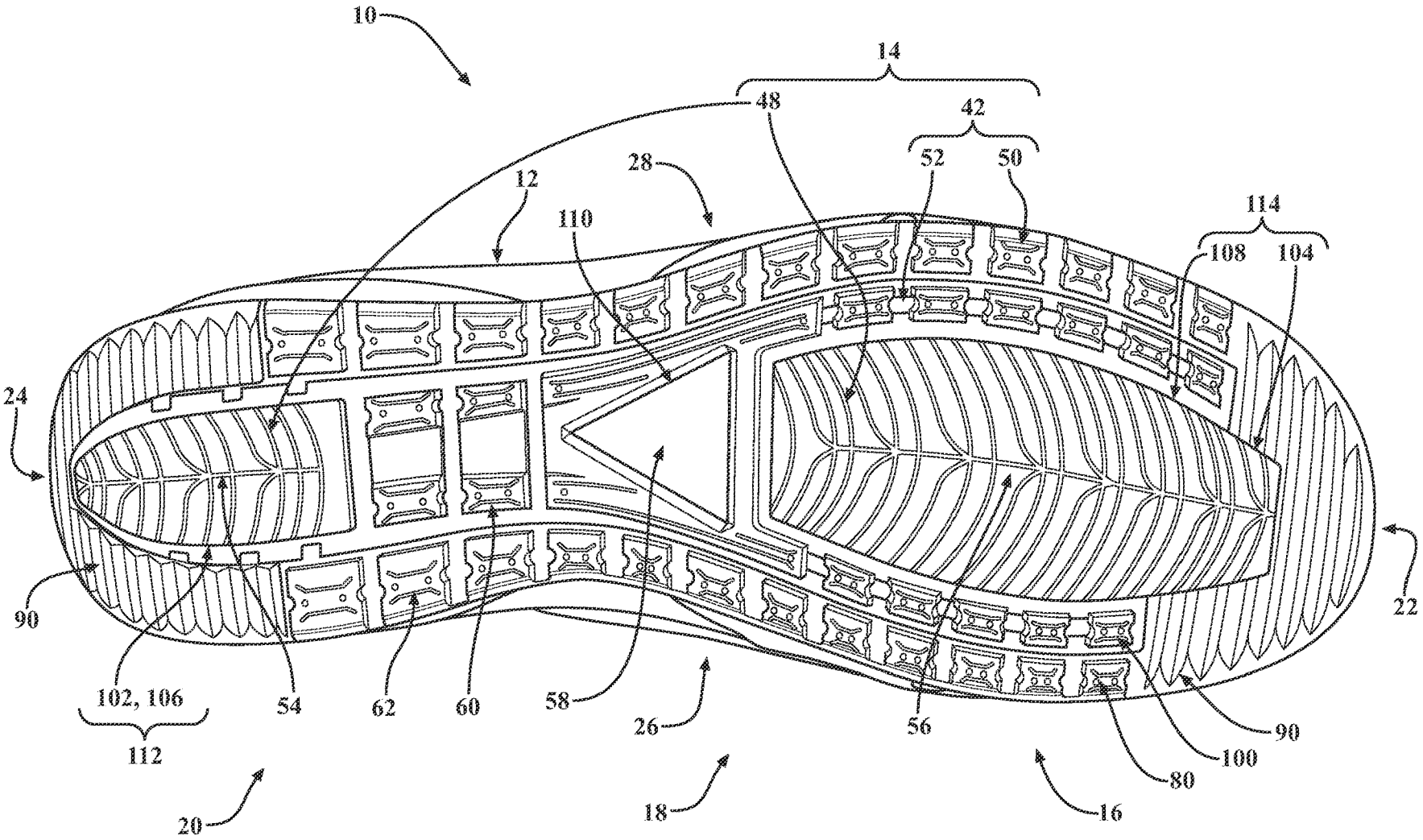
FIGS. 5 and 5A are view of a plurality of ground-facing or ground-contacting regions of the sole structure of the article of footwear of FIG. 1.
Figure 5A:
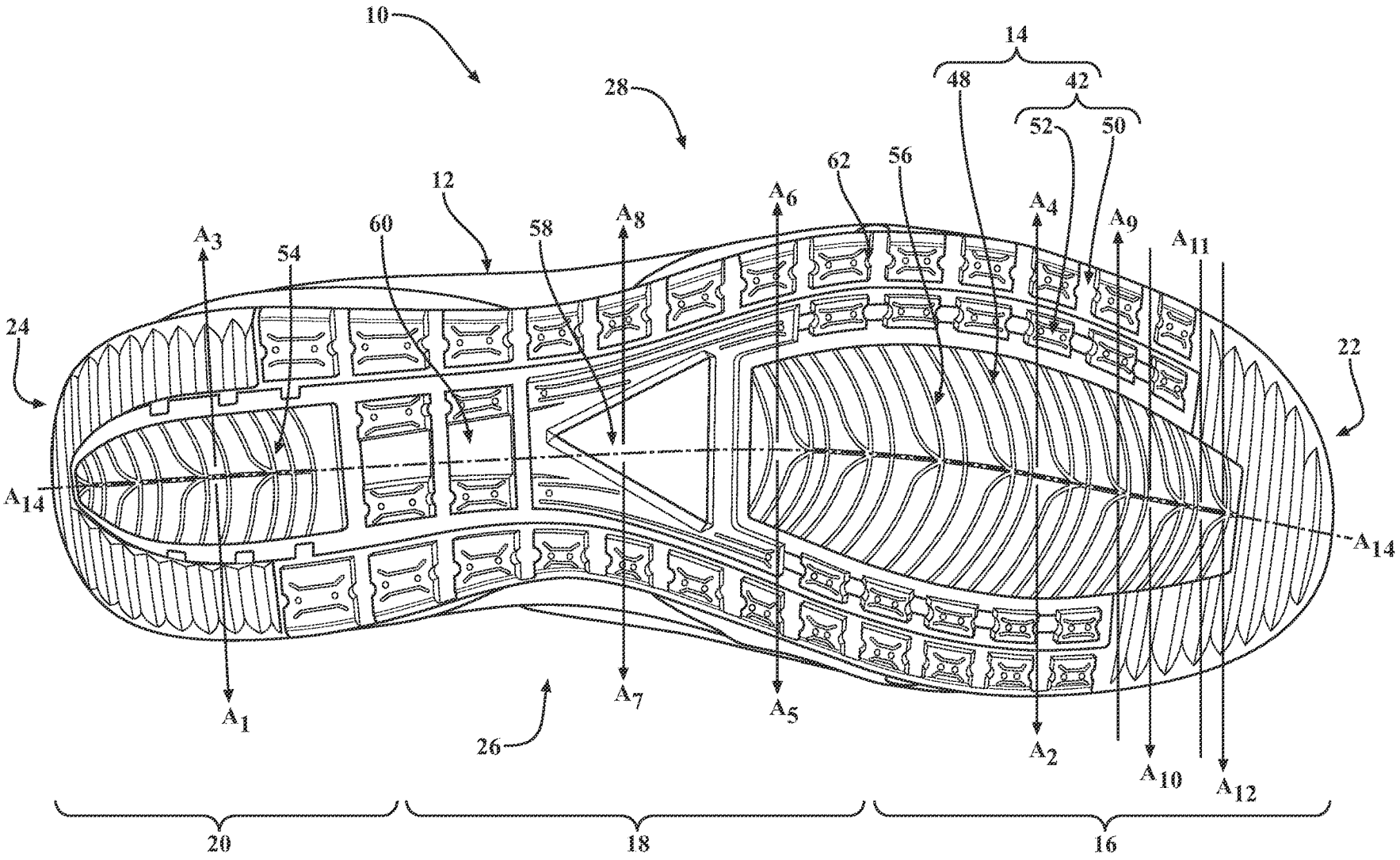

Referring to FIGS. 5 and 5A, the plurality of ground-facing or ground-contacting regions 54-62 may include five ground-facing or ground-contacting regions including one or more first inner-most ground-facing or ground-contacting regions 54-56, a second inner-most ground-facing or ground-contacting region 58, an intermediate ground-facing or ground-contacting region 60, and an outer-most ground-facing or ground-contacting region 62. Although the exemplary configuration of the plurality of ground-facing or ground-contacting regions 54-62 includes five ground-facing or ground-contacting regions, the sole structure 14 may include any desirable number of ground-facing or ground-contacting regions.

In an example, the plurality of ground-facing or ground-contacting regions 54-62 includes: (1) a first material having a first hardness and forming the one or more first inner-most ground-facing or ground-contacting regions 54-56; (2) a second material having a second hardness and forming the intermediate ground-facing or ground-contacting region 60; and (3) a third material having a third hardness forming each of the second inner-most ground-facing or ground-contacting region 58 and the outer-most ground-facing or ground-contacting region 62. The third hardness is harder than the second hardness, and the second hardness is harder than the first hardness. Although the exemplary sole structure 14 is described as including three differing hardnesses, the sole structure 14 may include any number of differing hardnesses such as four or more differing hardnesses.

In an example, the first hardness of the one or more first inner-most ground-facing or ground-contacting regions 54-56 may include a Shore A durometer ranging from a Shore A durometer of about 48 A to a Shore A durometer of about 54 A. In further configurations, the first hardness of the one or more first inner-most ground-facing or ground-contacting regions 54-56 may include a Shore A durometer ranging from a Shore A durometer of about 49 A to a Shore A durometer of about 53 A. In yet further configurations, the first hardness of the one or more first inner-most ground-facing or ground-contacting regions 54-56 may include a Shore A durometer ranging from a Shore A durometer of about 50 A to a Shore A durometer of about 52 A. In an example, the first hardness of the one or more first inner-most ground-facing or ground-contacting regions 54-56 may include a Shore A durometer approximately equal to about 51 A.

In an example, the second hardness of the intermediate ground-facing or ground-contacting region 60 may include a Shore A durometer ranging from a Shore A durometer of about 64 A to a Shore A durometer of about 70 A. In further embodiments, the second hardness of the intermediate ground-facing or ground-contacting region 60 may include a Shore A durometer ranging from a Shore A durometer of about 65 A to a Shore A durometer of about 69 A. In yet further embodiments, the second hardness of the intermediate ground-facing or ground-contacting region 60 may include a Shore A durometer ranging from a Shore A durometer of about 66 A to a Shore A durometer of about 68 A. In an example, the second hardness of the intermediate ground-facing or ground-contacting region 60 may include a Shore A durometer approximately equal to about 67 A.

In an example, the third hardness of each of the second inner-most ground-facing or ground-contacting region 58 and the outer-most ground-facing or ground-contacting region 62 may include a Shore A durometer ranging from a Shore A durometer of about 85 A to a Shore A durometer of about 91 A. In further configurations, the third hardness of each of the second inner-most ground-facing or ground-contacting region 58 and the outer-most ground-facing or ground-contacting region 62 may include a Shore A durometer ranging from a Shore A durometer of about 86 A to a Shore A durometer of about 90 A. In yet further configurations, the third hardness of each of the second inner-most ground-facing or ground-contacting region 58 and the outer-most ground-facing or ground-contacting region 62 may include a Shore A durometer ranging from a Shore A durometer of about 87 A to a Shore A durometer of about 89 A. In an example, the third hardness of each of the second inner-most ground-facing or ground-contacting region 58 and the outer-most ground-facing or ground-contacting region 62 may include a Shore A durometer approximately equal to about 88 A.

Referring to FIG. 5A, a plurality of exemplary hardness configurations of the sole structure 14 is described. In some examples, the hardness configurations of the sole structure 14 may be referenced from a direction (see, e.g., arrows $A_1$-$A_8$) extending from a longitudinal axis $A_{14}$-$A_{14}$ of the sole structure 14. In some instances, the longitudinal axis $A_{14}$-$A_{14}$ of the sole structure 14 is: (1) arranged between the medial side 26 of the sole structure 14 and the lateral side 28 of the sole structure 14; and (2) extends between the anterior end 22 of the sole structure 14 and the posterior end 24 of the sole structure.

In an example, the hardness of the sole structure 14 increases in a direction according to arrows $A_1$, $A_2$ and $A_5$ that extend from the longitudinal axis $A_{14}$-$A_{14}$ of the sole structure 14 toward the medial side 26 of the sole structure 14. In an example, the hardness of the sole structure 14 increases in a direction according to arrows $A_3$, $A_4$ and $A_6$ that extend from the longitudinal axis $A_{14}$-$A_{14}$ of the sole structure 14 toward the lateral side 28 of the sole structure 14.

In an implementation, the arrow $A_1$ that extends from the longitudinal axis $A_{14}$-$A_{14}$ toward the medial side 26 of the sole structure 14 respectively traverses: firstly, the ground-facing or ground-contacting region 54 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_1$ extends across the heel region 20 of the sole structure 14.

In another implementation, the arrow $A_2$ that extends from the longitudinal axis $A_{14}$-$A_{14}$ toward the medial side 26 of the sole structure 14 respectively traverses: firstly, the ground-facing or ground-contacting region 56 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_2$ extends across the forefoot region 16 of the sole structure 14.

In yet another implementation, the arrow $A_3$ that extends from the longitudinal axis $A_{14}$-$A_{14}$ toward the lateral side 28 of the sole structure 14 respectively traverses: firstly, the ground-facing or ground-contacting region 54 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_3$ extends across the heel region 20 of the sole structure 14.

In an implementation, the arrow $A_4$ that extends from the longitudinal axis $A_{14}$-$A_{14}$ toward the lateral side 28 of the sole structure 14 respectively traverses: firstly, the ground-facing or ground-contacting region 56 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_4$ extends across the forefoot region 16 of the sole structure 14.

In another implementation, the arrow $A_5$ that extends from the longitudinal axis $A_{14}$-$A_{14}$ toward the medial side 26 of the sole structure 14 respectively traverses: firstly, the ground-facing or ground-contacting region 56 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_5$ extends across the midfoot region 18 of the sole structure 14.

In yet another implementation, the arrow $A_6$ that extends from the longitudinal axis $A_{14}$-$A_{14}$ toward the lateral side 28 of the sole structure 14 respectively traverses: firstly, the ground-facing or ground-contacting region 56 of the one or more first inner-most ground-facing or ground-contacting regions 54, 56; secondly, the intermediate ground-facing or ground-contacting region 60; and thirdly, the outer-most ground-facing or ground-contacting region 62. Furthermore, in an example, the arrow $A_6$ extends across the midfoot region 18 of the sole structure 14.

Although a progressively increasing hardness of the sole structure 14 is described above according to the direction of the arrows $A_1$-$A_6$ extending away from the longitudinal axis $A_{14}$-$A_{14}$ toward either of the medial side 26 or the lateral side 28, the sole structure 14 may include other hardness configurations. In an example, the hardness of the sole structure 14 decreases and then increases in a direction according to arrow $A_7$ (extending from the longitudinal axis $A_{14}$-$A_{14}$ of the sole structure 14 toward the medial side 26 of the article of footwear 10) and arrow $A_8$ (extending from the longitudinal axis $A_{14}$-$A_{14}$ of the sole structure 14 toward the lateral side 28 of the article of footwear 10).

In an implementation, the arrow $A_7$ that extends from the longitudinal axis $A_{14}$-$A_{14}$ toward the medial side 26 of the sole structure 14 respectively traverses: firstly, the second inner-most ground-facing or ground-contacting region 58; secondly, the intermediate ground-facing or ground-contacting region 60; and thirdly, the outer-most ground-facing or ground-contacting region 62. Furthermore, in an example, the arrow $A_7$ extends across the midfoot region 18 of the sole structure 14.

In another implementation, the arrow $A_8$ that extends from the longitudinal axis $A_{14}$-$A_{14}$ toward the lateral side 28 of the sole structure 14 respectively traverses: firstly, the second inner-most ground-facing or ground-contacting region 58; secondly, the intermediate ground-facing or ground-contacting region 60; and thirdly, the outer-most ground-facing or ground-contacting region 62. Furthermore, in an example, the arrow $A_8$ extends across the midfoot region 18 of the sole structure 14.

Although a variety of hardness configurations of the sole structure 14 are described above according to the direction of the arrows $A_1$-$A_8$ extending away from the longitudinal axis $A_{14}$-$A_{14}$ toward either of the medial side 26 or the lateral side 28, the sole structure 14 may include other hardness configurations. In an example, the hardness configuration of the sole structure 14 may be referenced from a direction (see, e.g., arrows $A_9$, $A_{11}$) extending from: (1) the medial side 26 of the sole structure 14; (2) across the longitudinal axis $A_{14}$-$A_{14}$; and (3) toward the lateral side 28 of the sole structure 14. In another example, the hardness configuration of the sole structure 14 may be referenced from a direction (see, e.g., arrows $A_{10}$, $A_{12}$) extending from: (1) the lateral side 28 of the sole structure 14; (2) across the longitudinal axis $A_{14}$-$A_{14}$; and (3) toward the medial side 26 of the sole structure 14.

In an implementation, the arrow $A_9$ that extends from: (1) the medial side 26; (2) across the longitudinal axis $A_{14}$-$A_{14}$; and (3) toward the lateral side 28 of the sole structure 14 respectively traverses: firstly, the outer-most ground-facing or ground-contacting region 62; and secondly, the ground-facing or ground-contacting region 56 of the one or more first inner-most ground-facing or ground-contacting regions 54, 56 such that the hardness configuration of the sole structure 14 firstly decreases. Then, the arrow $A_9$ further traverses: thirdly, the intermediate ground-facing or ground-contacting region 60; and fourthly, the outer-most ground-facing or ground-contacting region 62 such that the hardness configuration of the sole structure 14 then progressively increases in a substantially similar manner as described above with respect to arrows $A_3$, $A_4$, $A_6$. Furthermore, in an example, the arrow $A_9$ extends across the forefoot region 16 of the sole structure 14.

In another implementation, the arrow $A_{10}$ that extends from: (1) the lateral side 28; (2) across the longitudinal axis $A_{14}$-$A_{14}$; and (3) toward the medial side 26 of the sole structure 14 respectively traverses: firstly, the outer-most ground-facing or ground-contacting region 62; secondly, the intermediate ground-facing or ground-contacting region 60; and thirdly, the ground-facing or ground-contacting region 56 of the one or more first inner-most ground-facing or ground-contacting regions 54, 56 such that the hardness configuration of the sole structure 14 firstly progressively decreases. Then, the arrow $A_{10}$ further traverses: fourthly, the outer-most ground-facing or ground-contacting region 62 such that the hardness configuration of the sole structure 14 then increases. Furthermore, in an example, the arrow $A_{10}$ extends across the forefoot region 16 of the sole structure 14.

In yet another implementation, the arrow $A_{11}$ that extends from: (1) the medial side 26; (2) across the longitudinal axis $A_{14}$-$A_{14}$; and (3) toward the lateral side 28 of the sole structure 14 respectively traverses: firstly, the outer-most ground-facing or ground-contacting region 62; and secondly, the ground-facing or ground-contacting region 56 of the one or more first inner-most ground-facing or ground-contacting regions 54, 56 such that the hardness configuration of the sole structure 14 firstly decreases. Then, the arrow Au further traverses: thirdly, the outer-most ground-facing or ground-contacting region 62 such that the hardness configuration of the sole structure 14 then increases. Furthermore, in an example, the arrow Au extends across the forefoot region 16 of the sole structure 14.

In an implementation, the arrow $A_{12}$ that extends from: (1) the lateral side 28; (2) across the longitudinal axis $A_{14}$-$A_{14}$; and (3) toward the medial side 26 of the sole structure 14 respectively traverses: firstly, the outer-most ground-facing or ground-contacting region 62; and secondly, the ground-facing or ground-contacting region 56 of the one or more first inner-most ground-facing or ground-contacting regions 54, 56 such that the hardness configuration of the sole structure 14 firstly decreases. Then, the arrow $A_{12}$ further traverses: thirdly, the outer-most ground-facing or ground-contacting region 62 such that the hardness configuration of the sole structure 14 then increases. Furthermore, in an example, the arrow $A_{12}$ extends across the forefoot region 16 of the sole structure 14.

Structural aspects of the exemplary five ground-facing or ground-contacting regions 54, 56, 58, 60, 62 of the plurality of ground-facing or ground-contacting regions 54-62 are described below at FIGS. 7, 9, and 12. Although the plurality of ground-facing or ground-contacting regions 54-62 may be selectively shaped to include one or more thicknesses, widths, lengths, recesses and the like, each ground-facing or ground-contacting region 54, 56, 58, 60, 62 of the plurality of ground-facing or ground-contacting regions 54-62 may include any desirable structural configuration in order to achieve a desired grip, traction, and flexibility characteristic for a particular region of the sole structure 14. Furthermore, in some instances, the structural configuration in combination with a selected material hardness of each ground-facing or ground-contacting region of the plurality of ground-facing or ground-contacting regions 54-62 achieves the desired grip, traction, and flexibility characteristic for a particular region of the sole structure 14.

In an example, the one or more inner-most ground-facing or ground-contacting regions 54-56 includes a first inner-most ground-facing or ground-contacting region 54 and a second inner-most ground-facing or ground-contacting region 56. The first inner-most ground-facing or ground-contacting region 54 may be elongate and extends across at least a portion of the heel region 20 of the sole structure 14. The second inner-most ground-facing or ground-contacting region 56 may be elongate and extends across at least a portion of the forefoot region 16. In some instances, the second inner-most ground-facing or ground-contacting region 56 may extend across at least a portion of the forefoot region 16 and the midfoot region 18.

As described above, each of the first inner-most ground-facing or ground-contacting region 54 and the second inner-most ground-facing or ground-contacting region 56 may include a first material having a first hardness that is less than the second hardness and the third hardness. The first material may include, for example, rubber. Furthermore, in an example, although each of the first inner-most ground-facing or ground-contacting region 54 and the second inner-most ground-facing or ground-contacting region 56 may include the same first material, each of the first inner-most ground-facing or ground-contacting region 54 and the second inner-most ground-facing or ground-contacting region 56 may include a different material having a similar but not the same first hardness. In an example, the first inner-most ground-facing or ground-contacting region 54 may include a material having a Shore A hardness approximately equal to about 51 A and the second inner-most ground-facing or ground-contacting region 56 may include a material having a Shore A hardness less than or greater than 51 A.

As described above, the second material includes a second hardness that is greater than the first hardness but less than the third hardness. The second material may include, for example, rubber. In an example, the intermediate ground-facing or ground-contacting region 60 may include a material having a Shore A hardness approximately equal to about 67 A.

As described above, the third material includes a third hardness that is greater than both of the first hardness and the second hardness. The third material may include, for example, rubber to provide the outer-most ground-facing or ground-contacting region 62 with a Shore A hardness approximately equal to about 88 A.

Figure 6:
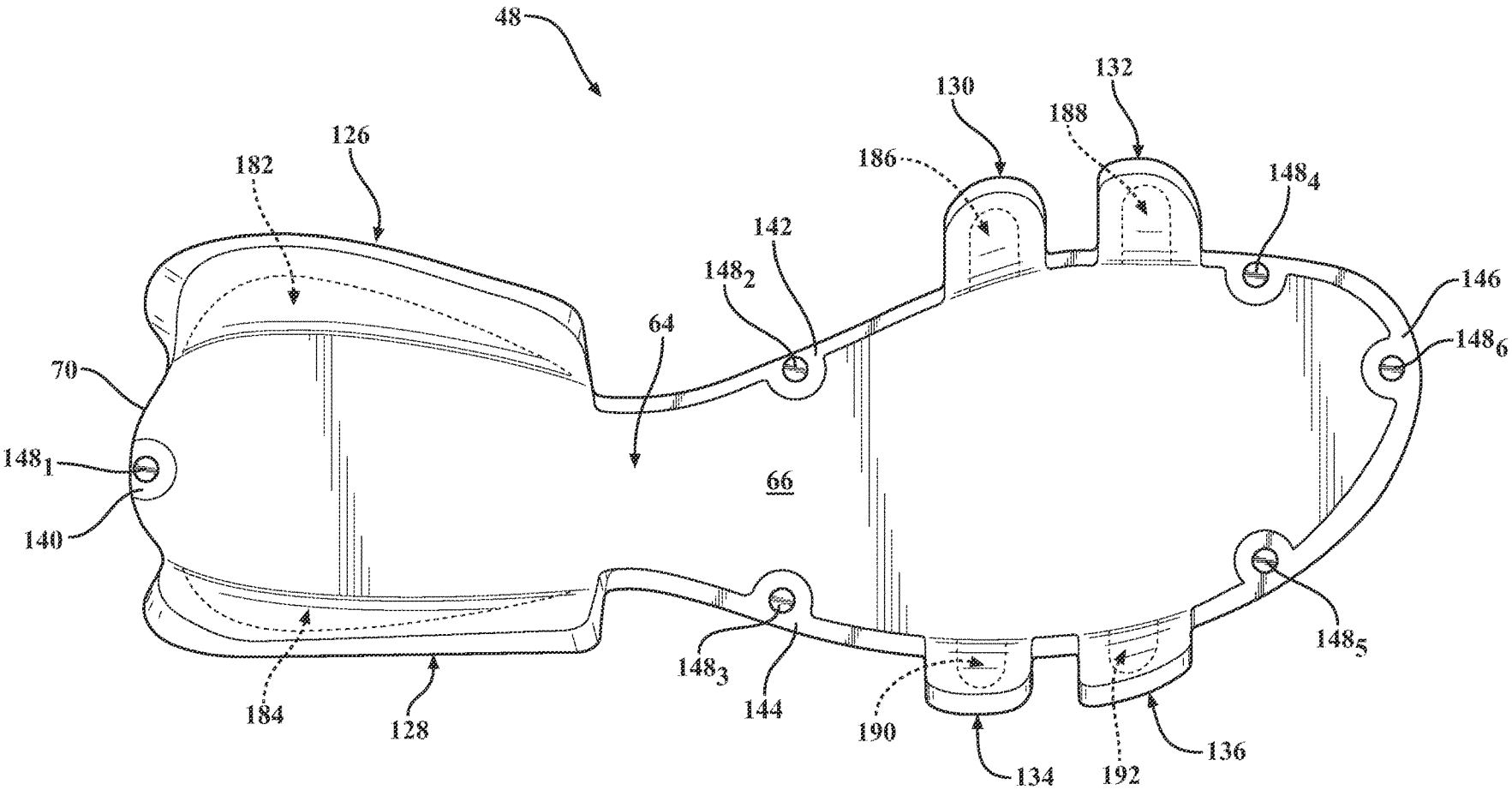
FIG. 6 is a top view of a midsole base layer of the article of footwear of FIG. 1.
Figure 8:
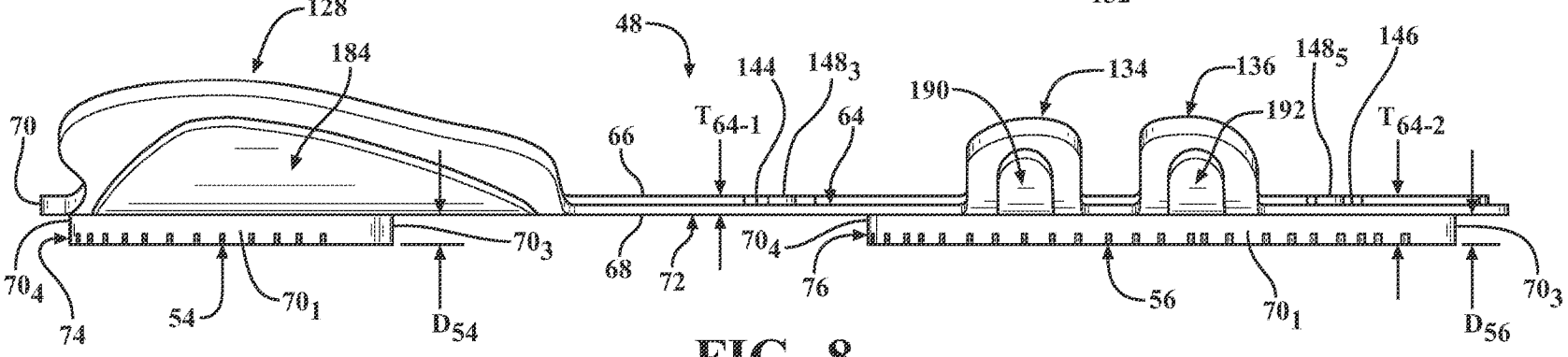
FIG. 8 is a lateral side view of the midsole base layer of FIG. 6.

Referring to FIGS. 6-8, the midsole base layer 48 includes a body 64 having an upper surface 66 (see FIG. 6), a lower surface 68 (see FIG. 7), and a side surface 70 (see FIGS. 6-8) joining the upper surface 66 to the lower surface 68.

With reference to FIGS. 7-8, a first portion of the lower surface 68 of the body 64 of the midsole base layer 48 includes the ground-facing or ground-contacting region 54 of the plurality of ground-facing or ground-contacting regions 54-62 of the sole structure 14. Furthermore, a second portion of the lower surface 68 of the body 64 of the midsole base layer 48 includes the ground-facing or ground-contacting region 56 of the plurality of ground-facing or ground-contacting regions 54-62 of the sole structure 14. A third portion of the lower surface 68 of the body 64 of the midsole base layer 48, which is shown generally at 72, does not contribute to defining any of the plurality of ground-facing or ground-contacting regions 54-62 of the sole structure 14.

Referring to FIG. 8, the body 64 of the midsole base layer 48 may include a non-constant thickness having at least a first thickness $T_{64-1}$ and a second thickness $T_{64-2}$. In an example, most of the body 64 of the midsole base layer 48 includes the first thickness $T_{64-1}$ that extends between the upper surface 66 of the body 64 and the third portion 72 of the lower surface 68 of the body 64. The first and second portions of lower surface 68 of the body 64 of the midsole base layer 48, that include the ground-facing or ground-contacting regions 54, 56, include the second thickness $T_{64-2}$. In an example, the second thickness $T_{64-2}$ is greater than the first thickness $T_{64-1}$.

In an implementation, when the second thickness $T_{64-2}$ is greater than the first thickness $T_{64-1}$, each of the first and second portions of lower surface 68 of the body 64 of the midsole base layer 48 that include the ground-facing or ground-contacting regions 54, 56 may respectively extend away from the third portion 72 of the lower surface 68 of the body 64 at a distance $D_{54}$, $D_{56}$. Accordingly, the second thickness $T_{64-2}$ may define the midsole base layer 48 to integrally include a first outer pad 74 that extends away from the third portion 72 of the lower surface 68 of the body 64 at the distance $D_{54}$ and a second outer pad 76 that extends away from the third portion 72 of the lower surface 68 of the body 64 at the distance $D_{56}$. As will be described in more detail below, the outer pads 74, 76 may form ground-facing or ground-contacting pads of the outsole 42 during use of the article of footwear 10. Accordingly, the outer pads 74, 76 may also be referred to herein as ground-facing pads 74, 76 or ground-contacting pads 76.

The side surface 70 of the body 64 of the midsole base layer 48 may further include side surface portions $\mathbf{70}_1$-$\mathbf{70}_4$ that define a shape or profile of each of the first ground-facing or ground-contact pad 74 and the second ground-facing or ground-contact pad 76. With reference to FIG. 7, in an example, the side surface portions $\mathbf{70}_1$-$\mathbf{70}_4$ define each of the first ground-facing or ground-contact pad 74 and the second ground-facing or ground-contact pad 76 to include a lateral side surface $\mathbf{70}_1$, a medial side surface $\mathbf{70}_2$, an anterior side surface $\mathbf{70}_3$ and a posterior side surface $\mathbf{70}_4$.

In an example, the posterior side surface $\mathbf{70}_4$ of the first ground-facing or ground-contact pad 74 generally defines an arcuate shape whereas the anterior side surface $\mathbf{70}_3$ of the first ground-facing or ground-contact pad 74 generally defines a straight or non-arcuate shape. In another example, each of the lateral side surface $70_1$ and the medial side surface $70_2$ of the first ground-facing or ground-contact pad 74 may define a straight or non-arcuate shape extending from the anterior side surface $70_3$ that transitions to an arcuate shape extending from the posterior side surface $70_4$.

In an example, the anterior side surface $70_3$ and the posterior side surface $70_4$ of the second ground-facing or ground-contact pad 76 generally define a straight or non-arcuate shape. In another example, each of the lateral side surface $70_1$ and the medial side surface $70_2$ of the second ground-facing or ground-contact pad 76 may define an arcuate shape extending from the anterior side surface $70_3$ to the posterior side surface $70_4$.

The ground-facing or ground-contacting regions 54, 56 that include the first ground-facing or ground-contact pad 74 and the second ground-facing or ground-contacting pad 76 may also include siping that defines a tread pattern. The siping extends into the thickness (see distance $D_{54}$, $D_{54}$) of each of the first ground-facing or ground-contact pad 74 and the second ground-facing or ground-contacting pad 76 from each ground-facing or ground-contacting region 54, 56. In an example, the siping may extend into but not entirely through the thickness (see distance $D_{54}$, $D_{54}$) of each of the first ground-facing or ground-contact pad 74 and the second ground-facing or ground-contact pad 76.

In an example, the siping may include a longitudinal sipe extending longitudinally between the anterior side surface $70_3$ and the posterior side surface $70_4$. The siping may be further include a plurality of arcuate sipes extending from the lateral side surface $70_1$ and the medial side surface $70_2$. The siping may further include a plurality of sinusoidal sipes having a first arcuate segment and a second arcuate segment, whereby the first arcuate segment includes a first concavity (e.g., concave down) and the second arcuate segment includes a second concavity (e.g., concave up).

Figure 10:
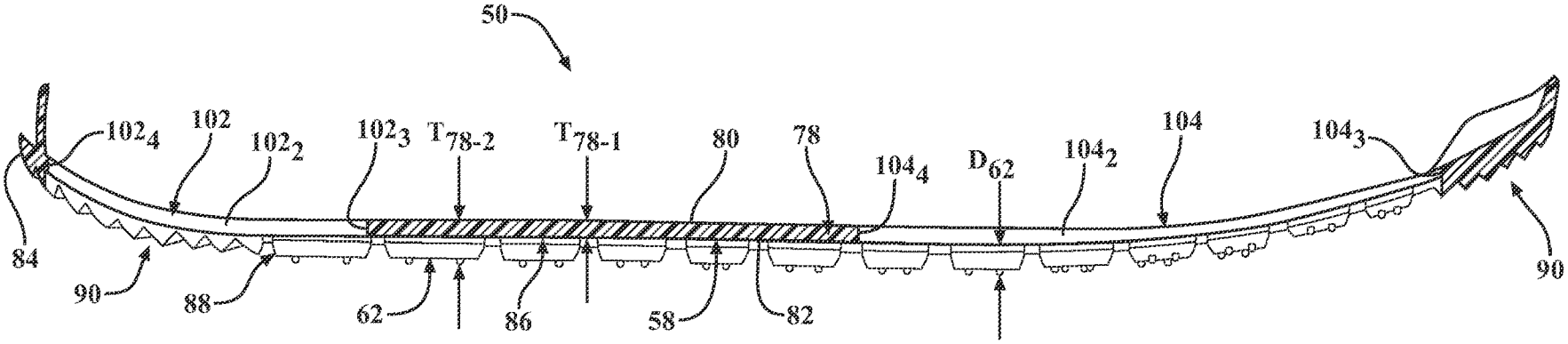
FIG. 10 is a cross-sectional view of the outsole base layer of FIG. 9 taken along Line 10-10 of FIG. 9.
Figure 11:
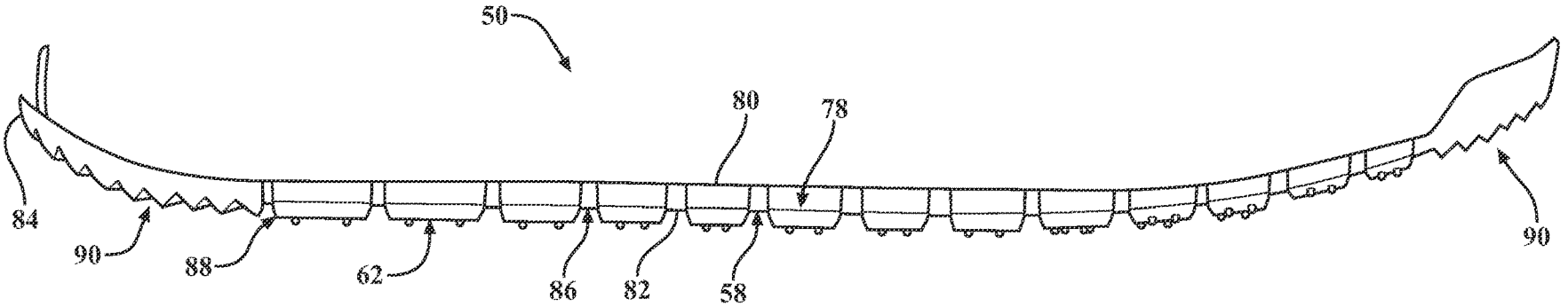
FIG. 11 is a lateral side view of the outsole base layer of FIG. 9.

Referring to FIGS. 9-11, the outsole base layer 50 includes a body 78 having an upper surface 80 (see FIGS. 10-11), a lower surface 82, and a side surface 84 (see FIGS. 10-11) joining the upper surface 80 to the lower surface 82. With reference to FIG. 9, a first or inner-most portion of the lower surface 82 (see, e.g., a substantially triangular phantom line) of the body 78 of the outsole base layer 50 includes the ground-facing or ground-contacting region 58 of the plurality of ground-facing or ground-contacting regions 54-62 of the sole structure 14. Furthermore, a second or outer-most portion of the lower surface 82 of the body 78 of the outsole base layer 50 includes the ground-facing or ground-contacting region 62 of the plurality of ground-facing or ground-contacting regions 54-62 of the sole structure 14. A third or intermediate portion of the lower surface 82 of the body 78 of the outsole base layer 50, which is shown generally at 86, does not contribute to defining any of the plurality of ground-facing or ground-contacting regions 54-62 of the sole structure 14. As seen in FIG. 9, the third or intermediate portion 86 of the lower surface 82 of the body 78 of the outsole base layer 50 may include a phantom line pattern corresponding to a shape, geometry or profile of the outsole insert layer 52 seen at FIG. 12.

Referring to FIG. 10, the body 78 of the outsole base layer 50 may further include a non-constant thickness having at least a first thickness $T_{78-1}$ and a second thickness $T_{78-2}$. In an example, the first thickness $T_{78-1}$ extends between the upper surface 80 and the first or inner-most portion of the lower surface 82 of the body 78 of the outsole base layer 50 that includes the ground-facing or ground-contacting region 58. In another example, the first thickness $T_{78-1}$ extends between the upper surface 80 and the third or intermediate portion 86 of the lower surface 82 of the body 78 of the outsole base layer 50. In yet another example, the second thickness $T_{78-2}$ extends between the upper surface 80 and the second portion of lower surface 82 of the body 78 of the outsole base layer 50 that includes the ground-facing or ground-contacting region 62. In an example the second thickness $T_{78-2}$ is greater than the first thickness $T_{78-1}$.

In an example, when the second thickness $T_{78-2}$ is greater than the first thickness $T_{78-1}$, the second or outer-most portion of the lower surface 82 of the body 78 of the outsole base layer 50 that includes the ground-facing or ground-contacting region 62 may extend away from the third or intermediate portion 86 of the lower surface 82 of the body 78 at a distance $D_{62}$. Accordingly, the second thickness $T_{78-2}$ may define the outsole base layer 50 to integrally include one or more traction elements 88-90 that extend away from the third or intermediate portion 86 of the lower surface 82 of the body 78 at the distance $D_{62}$ (that may define a thickness of the one or more traction elements 88-90). In an example, the one or more traction elements 88-90 may include one or more cleats 88, one or more ridges 90 or a combination of one or more cleats 88 and one or more ridges 90. As seen in FIG. 9, in an example, the one or cleats 88 may extend from the third or intermediate portion 86 of the lower surface 82 of the body 78 and be arranged across all of the midfoot region 18, some of the forefoot region 16 and some of the heel region 20. Furthermore, as seen in FIG. 9, in an example, the one or more ridges 90 may extend from the third or intermediate portion 86 of the lower surface 82 of the body 78 and be arranged across one or both of the forefoot region 16 and the heel region 20.

Figure 13:
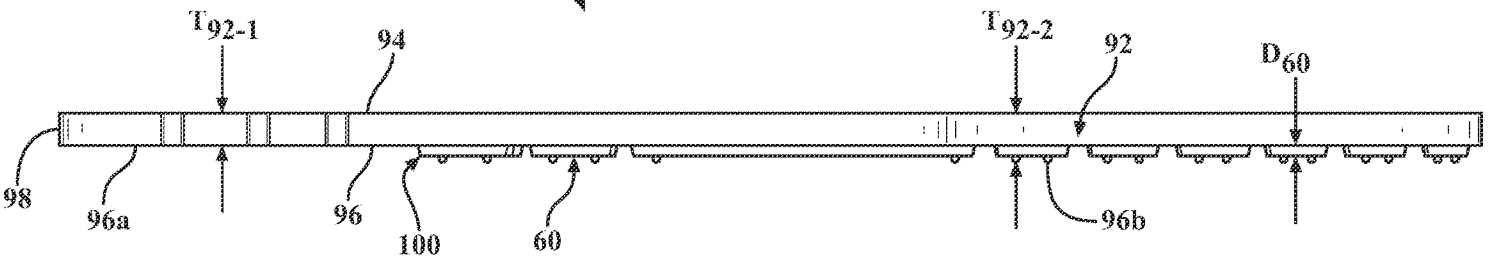
FIG. 13 is a lateral side view of the outsole insert layer of FIG. 12.

Referring to FIGS. 12-13, the outsole insert layer 52 includes a body 92 having an upper surface 94 (see FIG. 13), a lower surface 96 and a side surface 98 joining the upper surface 94 to the lower surface 96. The lower surface 96 of the outsole insert layer 52 may include the ground-facing or ground-contacting region 60.

Referring to FIG. 13, the body 92 of the outsole insert layer 52 may further include a non-constant thickness having at least a first thickness $T_{92-1}$ and a second thickness $T_{92-2}$. In an example, the first thickness $T_{92-1}$ extends between the upper surface 94 and a first portion **96*a* of the lower surface 96 of the body 92 of the outsole insert layer 52. In another example, the second thickness $T_{92-2}$ extends between the upper surface 94 and a second portion 96*b* of lower surface 96 of the body 92 of the outsole insert layer 52**. In an example the second thickness $T_{92-2}$ is greater than the first thickness $T_{92-1}$.

In an example, when the second thickness $T_{92-2}$ is greater than the first thickness $T_{92-1}$, the second portion **96*b* of the lower surface 96 of the body 92 of the outsole insert layer 52 may extend away from the first portion 96*a* of the lower surface 96 of the body 92 at a distance $D_{60}$. Accordingly, the second thickness $T_{92-2}$ may define the outsole insert layer 52 to integrally include one or more traction elements 100 that extend away from the first portion 96*a* of the lower surface 96 of the body 92 at the distance $D_{60}$. In an example, the one or more traction elements 100 may include one or more cleats 100. As seen in FIG. 12, in an example, the one or more cleats 100 extend from the first portion 96*a* of the lower surface 96 of the body 92 and are arranged across all of the midfoot region 18 and some of the forefoot region 16**.

In an example, the second thickness $T_{92-2}$ of the body 92 of the outsole insert layer 52 is approximately equal to the distance $D_{62}$ (see FIG. 10) extending between the third or intermediate portion 86 of the lower surface 82 of the body 78 of the outsole base layer 50. When the outsole 42 is assembled by disposing the outsole insert layer 52 adjacent the outsole base layer 50, at least a portion of the ground-facing or ground-contacting region 60 (e.g., the cleats 100) of the outsole insert layer 52 may be substantially co-planar with at least a portion of the ground-facing or ground-contacting region 62 (e.g., the cleats 88) of the outsole base layer 50.

Furthermore, as described above, each of the outsole base layer 50 of the outsole 42 and the outsole insert layer 52 of the outsole 42 includes at least one opening (see, e.g., 102-104 in FIGS. 9-10 and 106-110 in FIG. 12) that is sized for receiving and permitting passage of at least one portion of the midsole base layer 48; the at least one portion of the midsole base layer 48 includes the first ground-facing or ground-contact pad 74 and the second ground-facing or ground-contact pad 76. In an example, with reference to FIG. 8, the first ground-facing or ground-contact pad 74 and the second ground-facing or ground-contact pad 76 may respectively integrally extend from the third portion 72 of the lower surface 68 of the body 64 of the midsole base layer 48 at the distance $D_{54}$, $D_{56}$; each distance $D_{54}$, $D_{56}$ may respectively define a thickness of each of the first ground-facing or ground-contact pad 74 and the second ground-facing or ground-contact pad 76. In some instances, the thickness $D_{54}$, $D_{56}$ of each of the first ground-facing or ground-contact pad 74 and the second ground-facing or ground-contact pad 76 may be approximately equal to the second thickness $T_{78-2}$ (see FIG. 10) of the outsole base layer 50; accordingly, when the sole structure 14 is assembled by disposing the midsole base layer 48 adjacent the outsole 42, a portion of the ground-facing or ground-contacting regions 60, 62 (e.g., the cleats 100 and the cleats 88) of the outsole insert layer 52 and the outsole base layer 50 may be substantially co-planar with the ground-facing or ground-contacting region 54 of the first ground-facing or ground-contact pad 74 and the ground-facing or ground-contacting region 56 of the second ground-facing or ground-contact pad 76.

With reference to FIGS. 9-10, the at least one opening 102-104 of the outsole base layer 50 includes a first opening 102 and a second opening 104. As seen in FIG. 10, the first opening 102 of the outsole base layer 50 and the second opening 104 of the outsole base layer 50 extend through the first thickness $T_{78-1}$ of the body 78 of the outsole base layer 50.

In an example, the first opening 102 of the outsole base layer 50 defines a shape or profile similar to a shape or profile as seen, comparatively, in FIG. 7 of the first ground-facing or ground-contact pad 74 that extends from the lower surface 68 of the body 64 of the midsole base layer 48 and includes the ground-facing or ground-contacting region 54. In another example, the second opening 104 of the outsole base layer 50 defines a shape or profile similar to a shape or profile as seen, comparatively, in FIG. 7 of the second ground-facing or ground-contact pad 76 that extends from the lower surface 68 of the body 64 of the midsole base layer 48 and defines the ground-facing or ground-contacting region 56.

The side surface 84 of the body 78 of the outsole base layer 50 may further include side surface portions $102_1$-$102_4$, $104_1$-$104_4$ that respectively define a shape or profile of the first opening 102 and the second opening 104. With reference to FIG. 9, in an example, the side surface portions $102_1$-$102_4$, $104_1$-$104_4$ define each of the first opening 102 and the second opening 104 to include a lateral side surface $102_1$, $104_1$, a medial side surface $102_2$, $104_2$, an anterior side surface $102_3$, $104_3$ and a posterior side surface $102_4$, $104_4$.

In an example, the posterior side surface $102_4$ of the first opening 102 includes an arcuate shape whereas the anterior side surface $102_3$ of the first opening 102 includes a straight or non-arcuate shape. In another example, each of the lateral side surface $102_1$ and the medial side surface $102_2$ of the first opening 102 may define a straight or non-arcuate shape extending from the anterior side surface $102_3$ that transitions to an arcuate shape extending from the posterior side surface $102_4$.

In an example, the anterior side surface $104_3$ and the posterior side surface $104_4$ of the second opening 104 includes a straight or non-arcuate shape. In another example, each of the lateral side surface $104_1$ and the medial side surface $104_2$ of the second opening 104 may include an arcuate shape extending from the anterior side surface $104_3$ to the posterior side surface $104_4$.

As seen in FIG. 9, the first or inner-most portion of the lower surface 82 (see, e.g., the substantially triangular phantom line) of the body 78 of the outsole base layer 50 that defines the ground-facing or ground-contacting region 58 of the plurality of ground-facing or ground-contacting regions 54-62 of the sole structure 14 is generally arranged across the midfoot region 18. The first opening 102 of the outsole base layer 50 is generally arranged across the heel region 20, and the second opening 104 of the outsole base layer 50 is generally arranged across the forefoot region 16 and some of the midfoot region 18; accordingly, in an example, the first or inner-most portion of the lower surface 82 (see, e.g., the substantially triangular phantom line) may be arranged between the first opening 102 of the outsole base layer 50 and the second opening 104 of the outsole base layer 50.

With reference to FIG. 12, the at least one opening 106-110 of the outsole insert layer 52 includes a first opening 106, a second opening 108 and a third opening 110. The first opening 106 of the outsole insert layer 52, the second opening 108 of the outsole insert layer 52 and the third opening 110 of the outsole insert layer 52 extend through the first thickness $T_{92-1}$ of the body 92 of the outsole insert layer 52.

In an example, the first opening 106 of the outsole insert layer 52 defines a shape or profile similar to a shape or profile as seen, comparatively, in FIG. 7 of the first ground-facing or ground-contact pad 74 that extends from the lower surface 68 of the body 64 of the midsole base layer 48 and includes the ground-facing or ground-contacting region 54. In another example, the second opening 108 of the outsole insert layer 52 includes a shape or profile similar to a portion of the shape or profile as seen, comparatively, in FIG. 7 of the second ground-facing or ground-contact pad 76 that extends from the lower surface 68 of the body 64 of the midsole base layer 48 and includes the ground-facing or ground-contacting region 56.

The side surface 98 of the body 92 of the outsole insert layer 52 may further include side surface portions $106_1$-$106_4$, $108_1$-$108_2$, $108_4$ that respectively define a shape or profile of the first opening 106 and the second opening 108. With reference to FIG. 12, in an example, the side surface portions $106_1$-$106_2$, $106_4$, $108_1$-$108_2$, $108_4$ define each of the first opening 106 and the second opening 108 to include a lateral side surface $106_1$, $108_1$, a medial side surface $106_2$, $108_2$ and a posterior side surface $106_4$, $108_4$. As seen in FIG. 12, the first opening 106 is further defined by an anterior side surface $106_3$ whereas the second opening 108 is not defined by an anterior side surface (i.e., the body 92 of the outsole insert layer 52 defines the first opening 106 to be fully enclosed by four sides, including the lateral side surface 106$_1$, the medial side surface 106$_2$, the anterior side surface 106$_3$ and the posterior side surface 106$_4$ whereas the body 92 of the outsole insert layer 52 defines the second opening 108 to be partially enclosed by three sides, including the lateral side surface 108$_1$, the medial side surface 108$_2$ and the posterior side surface 106$_4$).

In an example, the posterior side surface 106$_4$ of the first opening 106 generally defines an arcuate shape whereas the anterior side surface 106$_3$ of the first opening 106 is generally defines a straight or non-arcuate shape. In another example, each of the lateral side surface 106$_1$ and the medial side surface 106$_2$ of the first opening 106 may define a straight or non-arcuate shape extending from the anterior side surface 106$_3$ that transitions to an arcuate shape extending from the posterior side surface 106$_4$.

In an example, the anterior side surface 108$_3$ of the second opening 108 generally includes a straight or non-arcuate shape. In another example, each of the lateral side surface 108$_1$ and the medial side surface 108$_2$ of the second opening 108 may define an arcuate shape extending from the posterior side surface 104$_4$.

As seen in FIG. 12, the first opening 106 of the outsole insert layer 52 is generally arranged across the heel region 20. Furthermore, as comparatively seen in FIGS. 9 and 12, the shape or profile of the first opening 106 of the outsole insert layer 52 may be substantially similar or proportionally similar to the shape or profile of the first opening 102 of the outsole base layer 50 that also is generally arranged across the heel region 20. Accordingly, when the outsole 42 is formed by disposing the upper surface 94 of the body 92 of the outsole insert layer 52 adjacent the third or intermediate portion 86 of the lower surface 82 of the body 78 of the outsole base layer 50 that is sized for receiving the outsole insert layer 52, the first opening 106 of the outsole insert layer 52 is aligned with the first opening 102 of the outsole base layer 50. With reference to FIG. 5, a result of the substantial similarity or proportional similarity of the shape or profile of the first opening 102 of the outsole base layer 50 and the shape or profile of the first opening 106 of the outsole insert layer 52, when the sole structure 14 is assembled as described above, the sole structure 14 may define a first pad passage or opening 112 generally arranged across the heel region 20.

As seen in FIG. 12, the second opening 108 of the outsole insert layer 52 is generally arranged across the forefoot region 16 and some of the midfoot region 18. Furthermore, as comparatively seen in FIGS. 9 and 12, the shape or profile of the second opening 108 of the outsole insert layer 52 may be substantially similar or proportionally similar to a portion of the shape or profile of the second opening 104 of the outsole base layer 50 that also is generally arranged across the forefoot region 16 and some of the midfoot region 18. Accordingly, when the outsole 42 is formed by disposing the upper surface 94 of the body 92 of the outsole insert layer 52 adjacent the third or intermediate portion 86 of the lower surface 82 of the body 78 of the outsole base layer 50 that is sized for receiving the outsole insert layer 52, the second opening 108 of the outsole insert layer 52 is aligned with the second opening 104 of the outsole base layer 50. With reference to FIG. 5, a result of the substantial similarity or proportional similarity of the shape or profile of the second opening 104 of the outsole base layer 50 and the shape or profile of the second opening 108 of the outsole insert layer 52, when the sole structure 14 is assembled as described above, the sole structure 14 may define a second pad passage or opening 114 generally arranged across the forefoot region 16.

Prior to forming the sole structure 14 by disposing the midsole base layer 48 adjacent the outsole 42, the first ground-facing or ground-contact pad 74 is aligned with the first pad opening 112 of the sole structure 14, and the second ground-facing or ground-contact pad 76 is aligned with the second pad opening 114 of the sole structure 14. Then, when the sole structure 14 is formed, the third portion 72 of the lower surface 68 of the body 64 of the midsole base layer 48 is disposed adjacent the upper surface 80 of the body 78 of the outsole base layer 50 such that: (1) the first ground-facing or ground-contact pad 74 enters and extends through the first pad opening 112 of the sole structure 14, and (2) the second ground-facing or ground-contact pad 76 enters and extends through the second pad opening 114 of the sole structure 14. Upon forming the sole structure 14, the portions of the ground-facing or ground-contacting regions 54, 56, 60 and 62 having the cleats 100 of the outsole insert layer 52, the cleats 88 of the outsole base layer 50 and the first and second ground-facing or ground-contact pads 74, 76 may be substantially co-planar.

As seen in FIG. 12, the third opening 110 of the outsole insert layer 52 is generally arranged across the midfoot region 18. In an example, the third opening 110 of the outsole insert layer 52 defines a triangular shape or profile. Although the third opening 110 defines a triangular shape or profile, the third opening 110 may define any desirable shape or profile.

Unlike the examples described above, the third opening 110 of the outsole insert layer 52 is not aligned with a corresponding opening formed by the outsole base layer 50. Accordingly, as seen in FIG. 5, when the outsole 42 is formed by disposing the upper surface 94 of the body 92 of the outsole insert layer 52 adjacent the third or intermediate portion 86 of the lower surface 82 of the body 78 of the outsole base layer 50, the third opening 110 of the outsole insert layer 52 exposes the first or inner-most portion of the lower surface 82 (see, e.g., the substantially triangular phantom line in FIG. 9) of the body 78 of the outsole base layer 50 that defines the ground-facing or ground-contacting region 58 of the plurality of ground-facing or ground-contacting regions 54-62 of the sole structure 14.

Furthermore, as seen at FIG. 5, when the sole structure 14 is formed by disposing the midsole base layer 48 adjacent the outsole 42, because the third opening 110 of the outsole insert layer 52 is not aligned with a corresponding opening formed by the outsole base layer 50 as described above, and, because a ground-facing or ground-contacting pad is not arranged within the third opening 110 of the outsole insert layer 52, the exposed portion of the first or inner-most portion of the lower surface 82 (see, e.g., the substantially triangular phantom line in FIG. 9) of the body 78 of the outsole base layer 50 is not co-planar with the ground-facing or ground-contacting regions 54, 56, 60, 62 defined by the cleats 100 of the outsole insert layer 52, the cleats 88 of the outsole base layer 50 or the first and second ground-facing or ground-contact pads 74, 76. Therefore, the exposed portion of the first or inner-most portion of the lower surface 82 (see, e.g., the substantially triangular phantom line in FIG. 9) of the body 78 of the outsole base layer 50 may be recessed within the sole structure 14 or offset from the ground-facing or ground-contacting regions 54, 56, 60, 62 at a distance approximately equal to the distance $D_{62}$ (see FIG. 10) that may define a thickness of the one or more traction elements 88-90 of the outsole base layer 50.

With reference to FIG. 12 and as described above, the first opening 106 formed by the body 92 of the outsole insert layer 52 is fully enclosed by four sides, including the lateral side surface $\mathbf{106}_1$, the medial side surface $\mathbf{106}_2$, the anterior side surface $\mathbf{106}_3$ and the posterior side surface $\mathbf{106}_4$, whereas the second opening 108 formed by the body 92 of the outsole insert layer 52 is partially enclosed by three sides, including the lateral side surface $\mathbf{108}_1$, the medial side surface $\mathbf{108}_2$ and the posterior side surface $\mathbf{106}_4$. Accordingly, the body 92 of the outsole insert layer 52 may include a ring portion 116 extending across the heel region 20 that defines the first opening 106 and a forked portion 118 extending across the forefoot region 16 and a portion of the midfoot region 18 that defines the second opening 108. An intermediate portion 120 extending across the midfoot region 18 connects the ring portion 116 to the forked portion 118. The intermediate portion 120 defines the third opening 110 formed by the body 92 of the outsole insert layer 52.

In an example, the forked portion 118 includes a lateral prong 122 and a medial prong 124. The lateral prong 122 extends away from the intermediate portion 120 at a first distance $D_{122}$. The medial prong 124 extends away from the intermediate portion 120 at a second distance $D_{124}$. In some configurations, the first distance $D_{122}$ defined by the lateral prong 122 is greater than the second distance $D_{124}$ defined by the medial prong 124. Although an exemplary configuration of the forked portion 118 is described to include two prongs 122, 124 extending at first and second distances $D_{122}$, $D_{124}$, the forked portion 118 may include any desirable number of prongs (e.g., one prong, two prongs, three prongs) extending at any desirable distances.

As described above, the shape or profile of the second opening 108 of the outsole insert layer 52 may be substantially similar or proportionally similar to a portion of the shape or profile of the second opening 104 of the outsole base layer 50. A difference in the similarity of the shape or profile of the second opening 108 of the outsole insert layer 52 with respect to the second opening 104 of the outsole base layer 50 is represented in phantom lines at FIG. 12, illustrating an absence of: a portion of lateral side surface $\mathbf{108}_1$', a portion of a medial side surface $\mathbf{108}_2$' and an entirety of an anterior side surface $\mathbf{108}_3$' that would otherwise result in the second opening 108 of the outsole insert layer 52 being enclosed in similar fashion as that of the second opening 104 of the outsole base layer 50. The absence $\mathbf{108}_1$', $\mathbf{108}_2$' of the portion of lateral side surface $\mathbf{108}_1$ and the medial side surface $\mathbf{108}_2$ defining the second opening 108 results from the lateral prong 122 and the medial prong 124 not extending to and terminating at the phantom line $\mathbf{108}_3$' represented by the absence of an anterior side surface that would otherwise further define the second opening 108. Accordingly, with reference to FIG. 7, when the sole structure 14 is formed by extending the second ground-facing or ground-contact pad 76 through the second pad opening 114 (see FIG. 5) of the sole structure 14 that is formed by both of the second opening 108 of the outsole insert layer 52 and the second opening 104 of the outsole base layer 50, a portion $\mathbf{70}_1$' of the lateral side surface $\mathbf{70}_1$ extending from the anterior side surface $\mathbf{70}_3$ of the second ground-facing or ground-contact pad 76, a portion $\mathbf{70}_2$' of the medial side surface $\mathbf{70}_2$ extending from the anterior side surface $\mathbf{70}_3$ of the second ground-facing or ground-contact pad 76 and all of the anterior side surface $\mathbf{70}_3$ of the second ground-facing or ground-contact pad 76 are not surrounded by the second opening 108 of the outsole insert layer 52. Therefore, with reference to FIG. 9, when the sole structure 14 is formed by extending the second ground-facing or ground-contact pad 76 through the second pad opening 114 of the sole structure 14 that is formed by both of the second opening 108 of the outsole insert layer 52 and the second opening 104 of the outsole base layer 50, the portion $\mathbf{70}_1$' of the lateral side surface $\mathbf{70}_1$ extending from the anterior side surface $\mathbf{70}_3$ of the second ground-facing or ground-contact pad 76, the portion $\mathbf{70}_2$' of the medial side surface $\mathbf{70}_2$ extending from the anterior side surface $\mathbf{70}_3$ of the second ground-facing or ground-contact pad 76 and all of the anterior side surface $\mathbf{70}_3$ of the second ground-facing or ground-contact pad 76 are surrounded by a portion $\mathbf{104}_1$' of the lateral side surface $\mathbf{104}_1$, a portion $\mathbf{104}_2$' of the medial side surface $\mathbf{104}_2$ and an entirety of the anterior side surface $\mathbf{104}_3$ of the second opening 104 of the outsole base layer 50.

Figure 3:
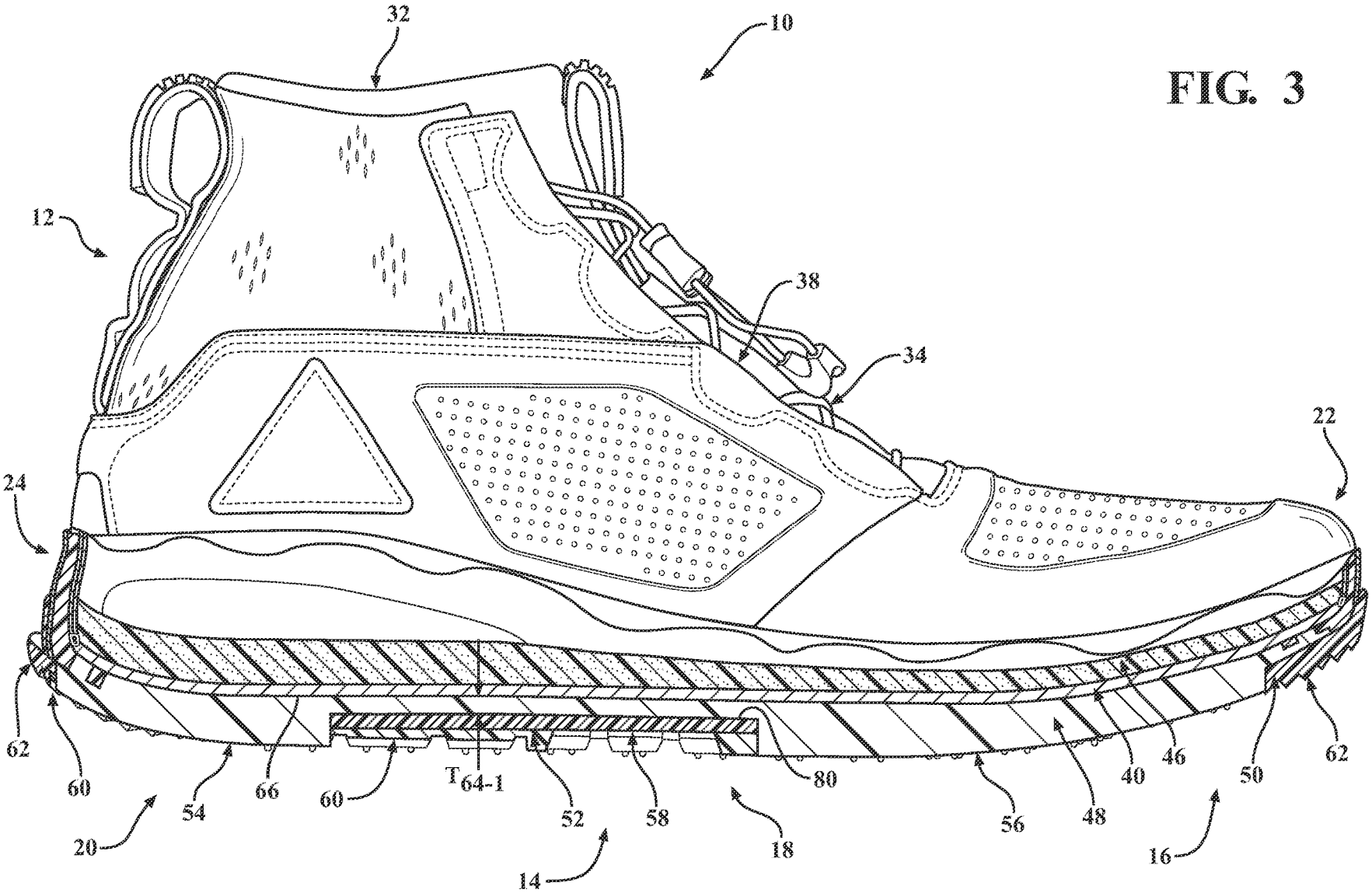
FIG. 3 is a lateral side view of the article of footwear of FIG. 1, illustrating an exemplary cross-sectional view of the sole structure.

Referring to FIGS. 3, 8 and 10, at least the first thickness $T_{64\text{-}1}$ of the body 64 of the midsole base layer 48 of the midsole 44 is disposed intermediate the strobel 40 and the upper surface 80 of the body 78 of the outsole base layer 50 of the outsole 42. As shown in FIG. 3, the upper surface 66 of the body 64 of the midsole base layer 48 of the midsole 44 opposes the strobel 40, and is disposed intermediate the strobel 40 and the outsole 42. However, as discussed above, the strobel 40 may not be included in some configurations, and the midsole 44 may be disposed directly intermediate the insole 46 and the outsole 42.

Referring to FIGS. 6-8 and 14, the midsole base layer 48 may further include a plurality of flange portions 126-136 that extend away from the side surface 70 of the body 64 of the midsole base layer 48. In an example, the plurality of flange portions 126-136 may include at least one heel region flange portion 126-128 and at least one forefoot region flange portion 130-136.

The at least one heel region flange portion 126-128 includes a medial side heel region flange portion 126 and a lateral side heel region flange portion 128. The at least one forefoot region flange portion 130-136 includes a pair of medial side forefoot region flange portions including a first medial side forefoot region flange portion 130 and a second medial side forefoot region flange portion 132. The at least one forefoot region flange portion 130-136 may further include and a pair of lateral side forefoot region flange portions including a first lateral side forefoot region flange portion 134 and a second lateral side forefoot region flange portion 136. As seen in FIGS. 7-8, each flange portion 126, 128, 130, 132, 134, 136 of the plurality of flange portions 126-136 includes an embossed portion 138.

Figure 14:
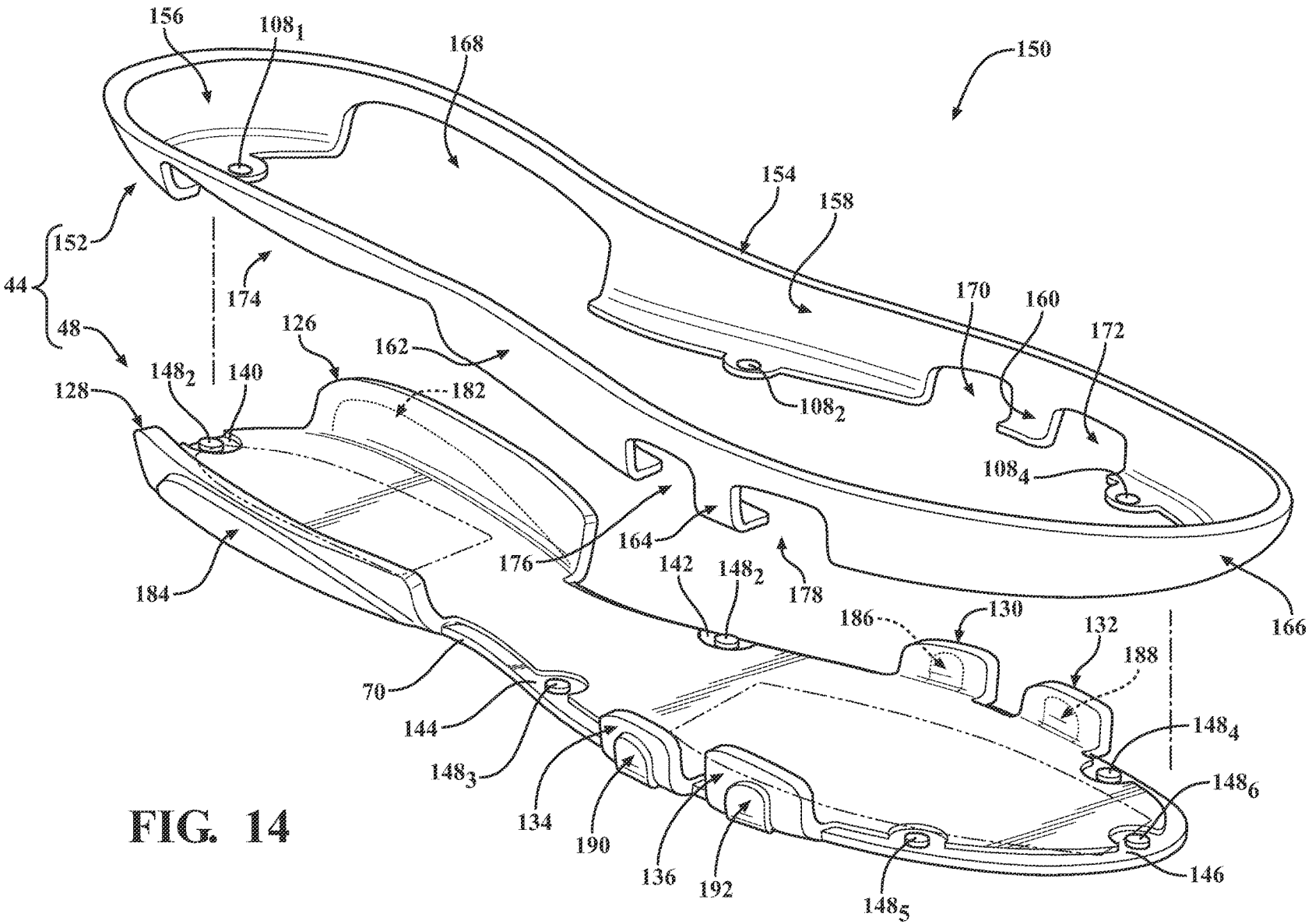
FIG. 14 is an exploded view of a midsole assembly of the article of footwear of FIG. 1 including the midsole base layer of FIG. 6 and an optional midsole perimeter portion.

Referring to FIGS. 6 and 14, the upper surface 66 of the body 64 of the midsole base layer 48 further includes a plurality of recessed ledge surfaces 140-146 extending from the side surface 70. The plurality of recessed ledge surfaces 140-146 include a posterior recessed ledge surface 140, a medial side recessed ledge surface 142, a lateral side recessed ledge surface 144 and an anterior side recessed ledge surface 146. At least one embossed portion $\mathbf{148}_1$-$\mathbf{148}_6$ may extend away from each recessed ledge surface 140, 142, 144, 146 of the plurality of recessed ledge surfaces 140-146. In an example, each of the posterior recessed ledge surface 140, the medial side recessed ledge surface 142 and the lateral side recessed ledge surface 144 may include one embossed portion (see, e.g., $\mathbf{148}_1$, $\mathbf{148}_2$, $\mathbf{148}_3$) whereas the anterior side recessed ledge surface 146 includes three embossed portions (see, e.g., $\mathbf{148}_4$, $\mathbf{148}_5$, $\mathbf{148}_6$).

Figure 15:
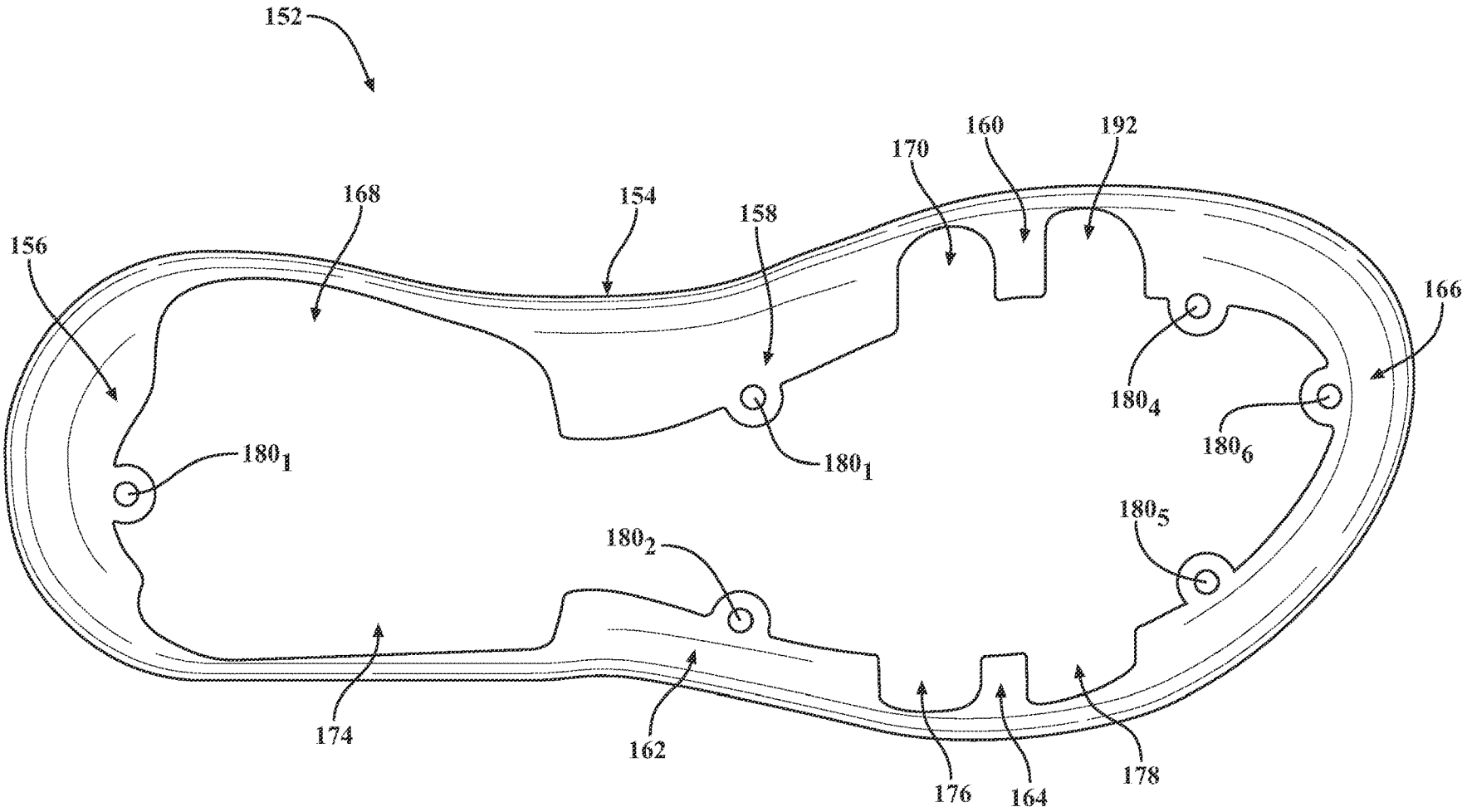
FIG. 15 is a top view of the optional midsole perimeter portion of the midsole assembly of FIG. 14.
Figure 16:
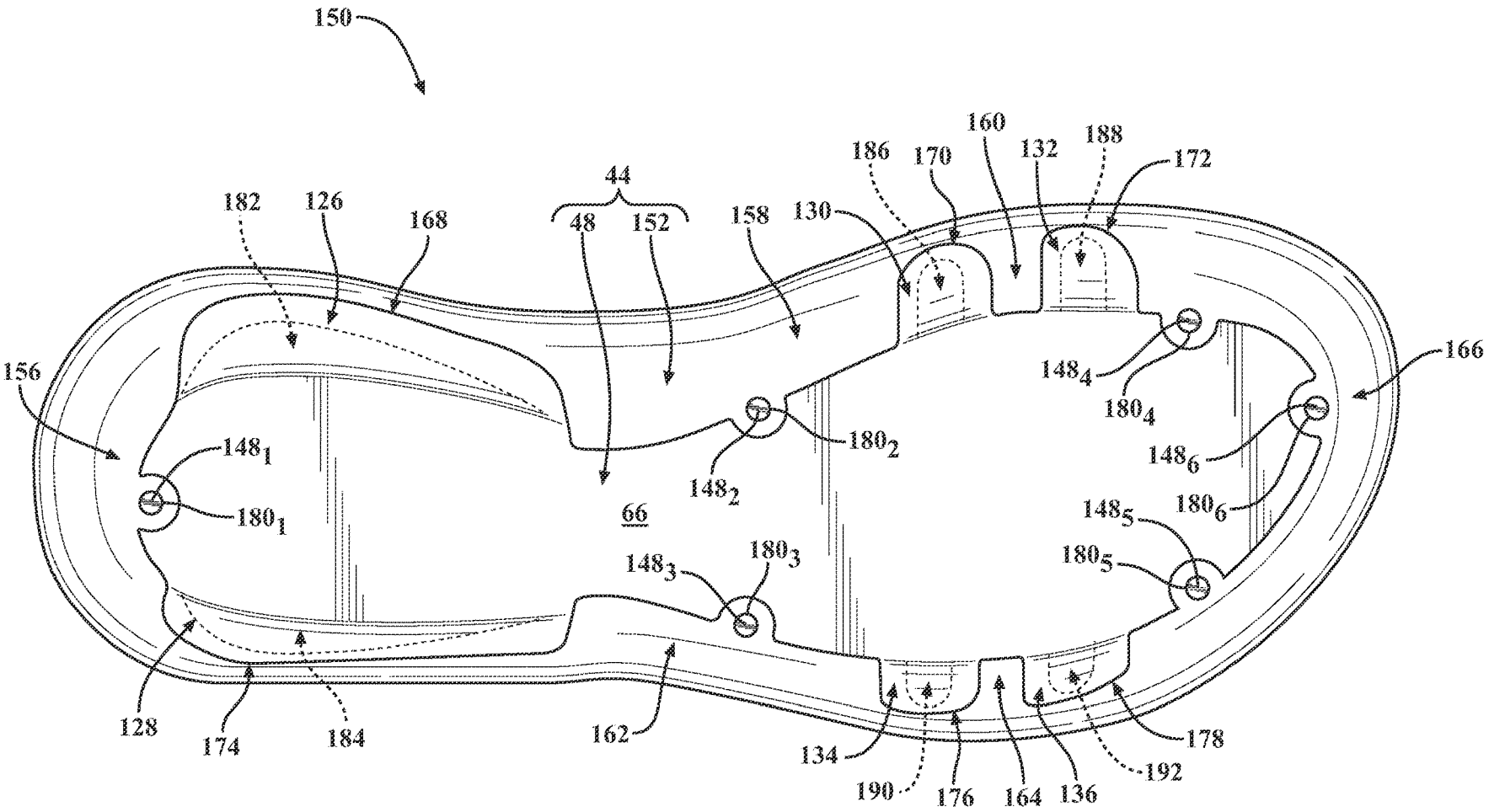
FIG. 16 is a top assembled view of the midsole assembly of FIG. 14.
Figure 17:
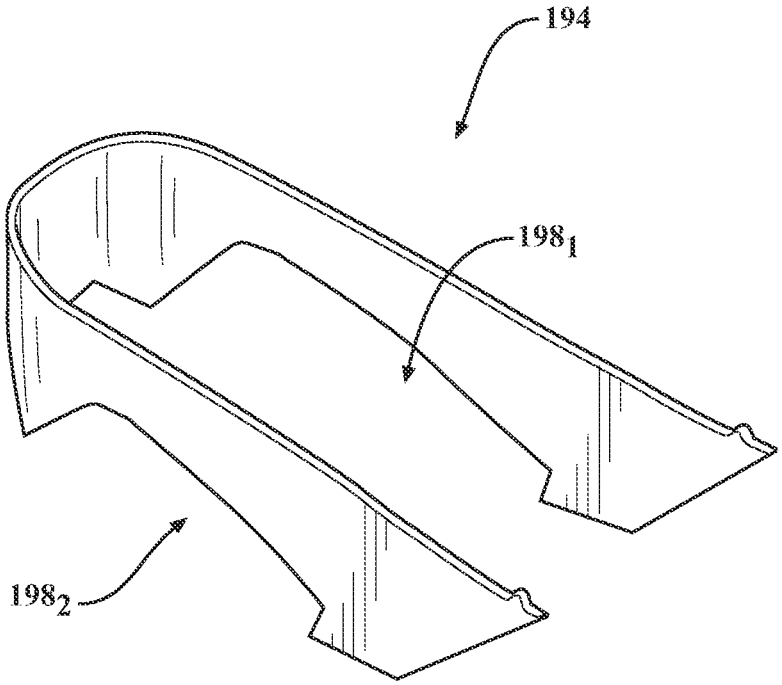
FIG. 17 is a perspective view of an optional heel region trim band of the article of footwear of FIG. 1.
Figure 19:
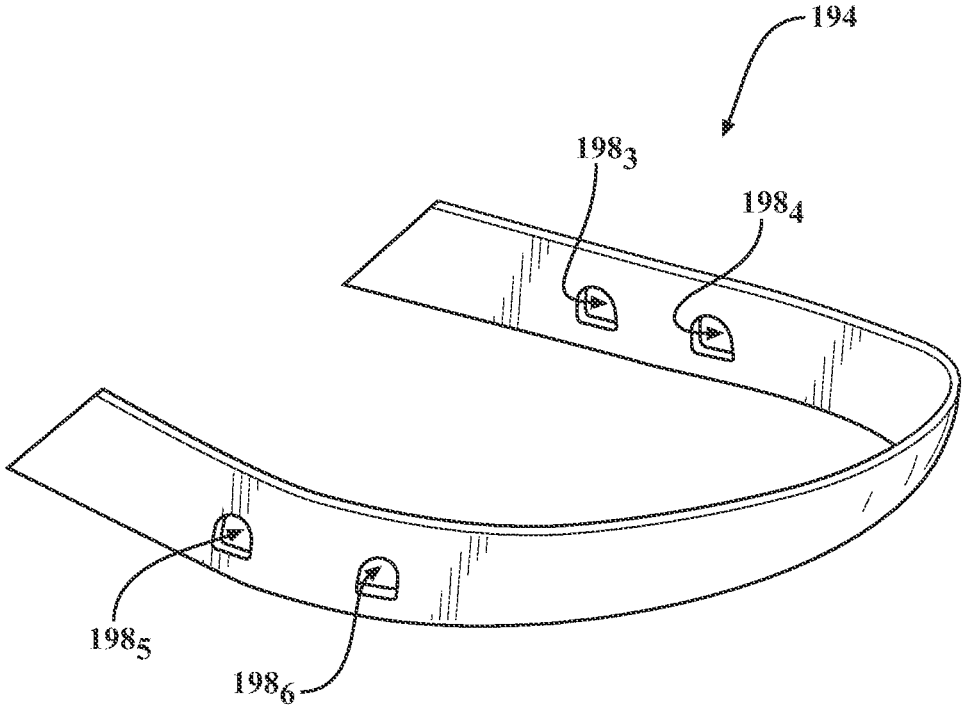
FIG. 19 is a perspective view of an optional forefoot region trim band of the article of footwear of FIG. 1.
Figure 18:
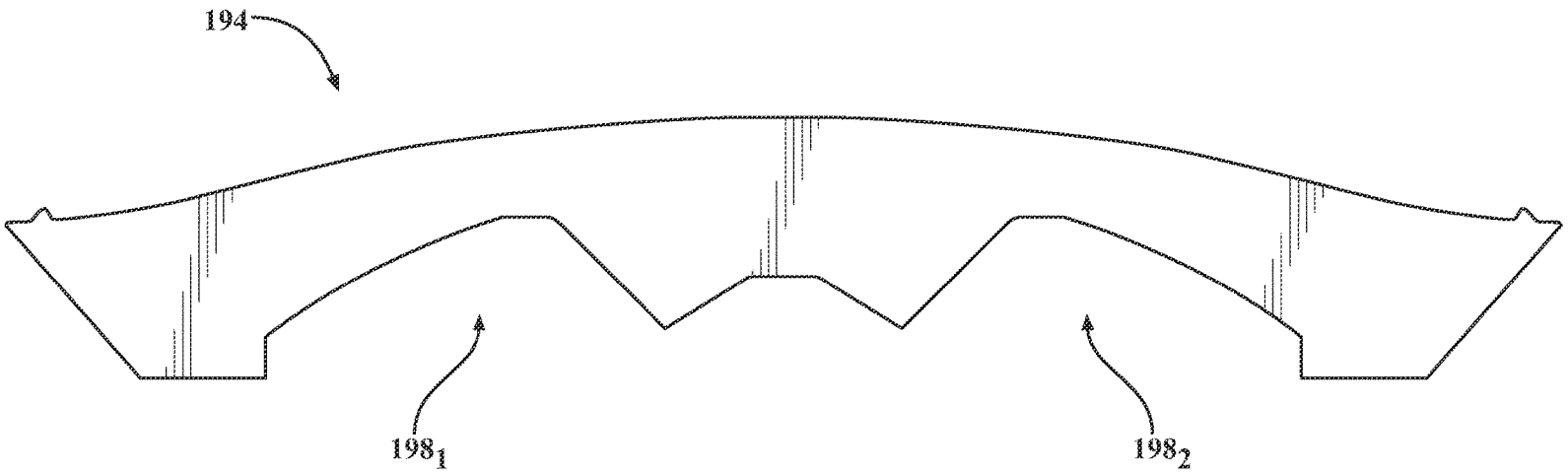
FIG. 18 is a flattened top view of the optional heel region trim band of FIG. 17.
Figure 20:
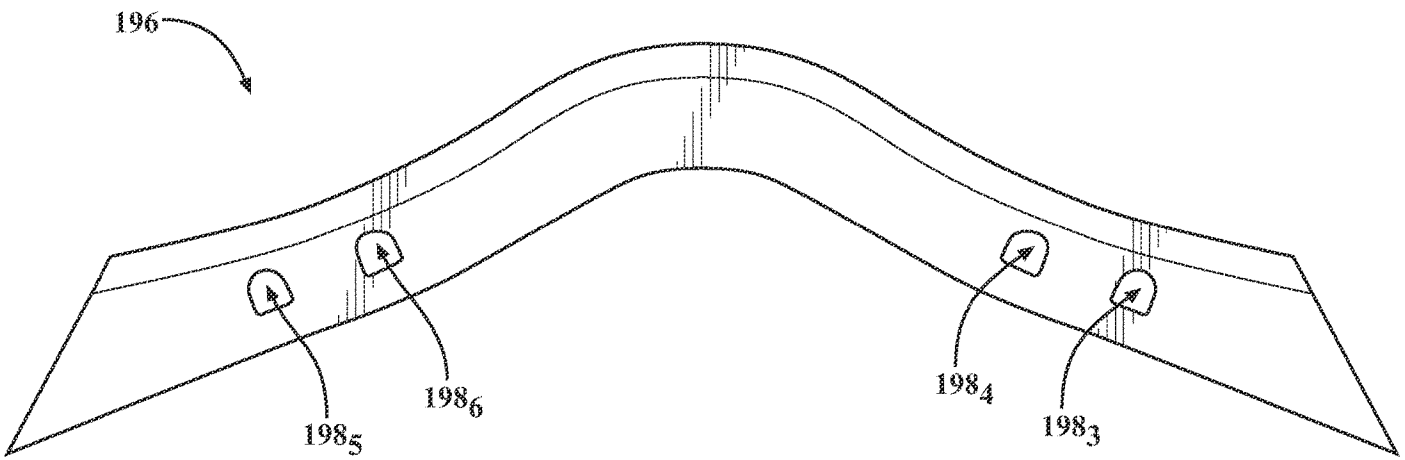
FIG. 20 is a flattened top view of the optional forefoot region trim band of FIG. 19.

Referring to FIGS. 4, 14 and 16, the midsole 44 may include a midsole assembly that is shown generally at 150. The midsole assembly 150 may include the midsole base layer 48 and an optional midsole perimeter portion 152 (see FIGS. 4 and 14-16).

As seen in FIGS. 14-15, the midsole perimeter portion 152 may include a loop body portion 154 that includes a plurality of flange portions 156-166. The plurality of flange portions 156-166 includes a posterior flange portion 156, a first medial side flange portion 158, a second medial side flange portion 160, a first lateral side flange portion 162, a second lateral side flange portion 164 and an anterior flange portion 166.

In an example, some of the plurality of flange portions 156-166 form medial side windows 168-172 of the midsole perimeter portion 152. The posterior flange portion 156 and the first medial side flange portion 158 form a heel region passage or first medial side window 168 of the midsole perimeter portion 152 that is sized for receiving the medial side heel region flange portion 126 of the midsole base layer 48. The first medial side flange portion 158 and the second medial side flange portion 160 form a second medial side window 170 (e.g., a forefoot region passage) of the midsole perimeter portion 152 that is sized for receiving the first medial side forefoot region flange portion 130 of the midsole base layer 48. The second medial side flange portion 160 and the anterior flange portion 166 form a third medial side window 172 (e.g., a forefoot region passage) of the midsole perimeter portion 152 that is sized for receiving the second medial side forefoot region flange portion 132 of the midsole base layer 48.

In another example, some of the plurality of flange portions 156-166 form lateral side windows 174-178 of the midsole perimeter portion 152. The posterior flange portion 156 and the first lateral side flange portion 162 form a first lateral side window 174 (e.g., a heel region passage) of the midsole perimeter portion 152 that is sized for receiving the lateral side heel region flange portion 128 of the midsole base layer 48. The first lateral side flange portion 162 and the second lateral side flange portion 164 form a second lateral side window 176 (e.g., a forefoot region passage) of the midsole perimeter portion 152 that is sized for receiving the first lateral side forefoot region flange portion 134 of the midsole base layer 48. The second lateral side flange portion 164 and the anterior flange portion 166 form a third lateral side window 178 (e.g., a forefoot region passage) of the midsole perimeter portion 152 that is sized for receiving the second lateral side forefoot region flange portion 136 of the midsole base layer 48.

In yet another example, some of the plurality of flange portions 156-166 of the midsole perimeter portion 152 form embossed portion receiving passages $\mathbf{180_1}$-$\mathbf{180_6}$. In an example, the posterior flange portion 156 of the midsole perimeter portion 152 includes one embossed portion receiving passage $\mathbf{180_1}$ that is sized for receiving the one embossed portion $\mathbf{148_1}$ of the posterior recessed ledge surface 140 of the midsole base layer 48. In another example, the first medial side flange portion 158 of the midsole perimeter portion 152 includes one embossed portion receiving passage $\mathbf{180_2}$ that is sized for receiving the one embossed portion $\mathbf{148_2}$ of the medial side recessed ledge surface 142 of the midsole base layer 48. In yet another example, the first lateral side flange portion 162 of the midsole perimeter portion 152 includes one embossed portion receiving passage $\mathbf{180_3}$ (see FIGS. 15-16) that is sized for receiving the one embossed portion $\mathbf{148_3}$ of the lateral side recessed ledge surface 144 of the midsole base layer 48. In another example, the anterior flange portion 166 of the midsole perimeter portion 152 includes three embossed portion receiving passages $\mathbf{180_4}$-$\mathbf{180_6}$ (see FIGS. 15-16) that are sized for receiving the three embossed portions $\mathbf{148_4}$-$\mathbf{148_6}$ of the anterior side recessed ledge surface 146 of the midsole base layer 48.

Referring to FIGS. 6-8, 14 and 16, each flange portion 126, 128, 130, 132, 134, 136 of the plurality of flange portions 126-136 of the midsole base layer 48 may include an embossed portion 182-192. In an example, the medial side heel region flange portion 126 includes a medial side heel region embossed portion 182, and the lateral side heel region flange portion 128 includes a lateral side heel region embossed portion 184. In another example, the first medial side forefoot region flange portion 130 includes a first medial side forefoot region embossed portion 186, and the second medial side forefoot region flange portion 132 includes a second medial side forefoot region embossed portion 188. In yet another example, the first lateral side forefoot region flange portion 134 includes a first lateral side forefoot region embossed portion 190, and the second lateral side forefoot region flange portion 136 includes a second lateral side forefoot region embossed portion 192.

Referring to FIGS. 4 and 17-22, the midsole 44 may further include one or more optional trim bands 194-196. Referring to FIGS. 17-20, each trim band of the one or more optional trim bands 194-196 may define a window $\mathbf{198_1}$-$\mathbf{198_6}$ that is sized for permitting passage of, for example, an embossed portion of the embossed portions 182-192 extending from a flange portion of the flange portions 126-136 of the midsole base layer 48; accordingly, with reference to FIGS. 4 and 21-22, a trimmed midsole assembly 200 may include the one or more optional trim bands 194-196 attached to the midsole assembly 150.

In an example, the one or more optional trim bands 194-196 may include an optional midsole heel trim band 194 (see FIGS. 4, 17-18 and 21). In another example the one or more optional trim bands 194-196 may include an optional midsole forefoot trim band 196 (see FIGS. 4, 19-20 and 22).

In an implementation, the optional midsole heel trim band 194 defines a medial side heel region window $\mathbf{198_1}$ that is sized for receiving the medial side heel region embossed portion 182 of the medial side heel region flange portion 126, and a lateral side heel region window $\mathbf{198_2}$ that is sized for receiving the lateral side heel region embossed portion 184 of the lateral side heel region flange portion 128. In another implementation, the optional midsole forefoot trim band 196 defines a pair of medial side forefoot region windows including a first medial side forefoot region window $\mathbf{198_3}$ that is sized for receiving the first medial side forefoot region embossed portion 186 of the first medial side forefoot region flange portion 130, and a second medial side forefoot region $\mathbf{198_4}$ that is sized for receiving the second medial side forefoot region embossed portion 188 of the second medial side forefoot region flange portion 132. In yet another implementation, the optional midsole forefoot trim band 196 defines a pair of lateral side forefoot region windows including a first lateral side forefoot region window $\mathbf{198_5}$ that is sized for receiving the first lateral side forefoot region embossed portion 190 of the first lateral side forefoot region flange portion 134, and a second lateral side forefoot region window $\mathbf{198_6}$ that is sized for receiving the second lateral side forefoot region embossed portion 192 of the second lateral side forefoot region flange portion 136.

The foregoing article of footwear 10 incorporates a sole structure 14 that includes a plurality of regions having different hardness characteristics (e.g., sticky rubber for providing higher friction and hard rubber defining cleats) that react differently when engaged with an underlying ground surface. Accordingly, the article of footwear 10 may be used for a variety of athletic activities such as hiking, biking, rock climbing, running, basketball, or the like.

The following Clauses provide an exemplary configuration for a sole structure and an article of footwear described above.

Clause 1. A sole structure of an article of footwear, the sole structure comprising (i) a first outer region at least partially disposed a first distance from a longitudinal axis and having a first hardness, (ii) a second outer region at least partially disposed a second distance from the longitudinal axis and having a second hardness that is greater than the first hardness, and (iii) a third outer region at least partially disposed between the first outer region and the second outer region a third distance from the longitudinal axis and having a third hardness that is greater than the first hardness and less than the second hardness, wherein the second distance is greater than the first distance, and the third distance is greater than the first distance and less than the second distance.

Clause 2. The sole structure of Clause 1, wherein the first distance, the second distance, and the third distance extend away from a longitudinal axis of the sole structure toward a medial side or a lateral side of the sole structure.

Clause 3. The sole structure of Clause 1, wherein the first outer region is an inner-most outer region and the second outer region is an outer-most outer region.

Clause 4. The sole structure of Clause 1, wherein the first outer region, the second outer region and the third outer region are each formed from a different material.

Clause 5. The sole structure of Clause 1, wherein the first outer region includes a first material having the first hardness, wherein the second outer region includes a second material having the second hardness, and wherein the third outer region includes a third material having the third hardness.

Clause 6. The sole structure of Clause 1, wherein the first hardness includes a Shore A durometer value greater than 48 and less than 54.

Clause 7. The sole structure of Clause 1, wherein the third hardness includes a Shore A durometer value greater than 64 and less than 70.

Clause 8. The sole structure of Clause 1, wherein the second hardness includes a Shore A durometer value greater than 85 and less than 91.

Clause 9. The sole structure of Clause 1, wherein the sole structure includes an outsole including the second outer region and the third outer region and defining a first passage and a midsole including a first outer pad disposed within the first passage, the first outer pad including the first outer region.

Clause 10. The sole structure of Clause 9, wherein the first passage is disposed within a heel region of the sole structure and wherein the sole structure further includes a second passage disposed within one of a forefoot region or a midfoot region of the sole structure, and wherein the midsole includes a second outer pad disposed within the second passage.

Clause 11. The sole structure of Clause 9, wherein the outsole includes an outsole base layer including the second outer region and at least one opening and an outsole insert layer including the third outer region and at least one opening, wherein the at least one opening of the outsole base layer is aligned with the at least one opening of the outsole insert layer.

Clause 12. The sole structure of Clause 11, wherein the midsole includes a first material having the first hardness, wherein the outsole base layer includes a second material having the second hardness, wherein the outsole insert layer includes a third material having the third hardness.

Clause 13. The sole structure of Clause 11, wherein the outsole insert layer includes an intermediate portion, a ring portion extending from the intermediate portion and defining the first passage, and a forked portion extending from the intermediate portion and defining a second passage.

Clause 14. The sole structure of Clause 13, wherein the forked portion includes a lateral prong and a medial prong.

Clause 15. The sole structure of Clause 9, wherein the midsole includes a midsole base layer including an upper surface and a lower surface and a midsole perimeter portion connected to the upper surface of the midsole base layer, wherein the first outer pad extends from the lower surface of the midsole base layer and through the first passage of the outsole.

Clause 16. The sole structure of Clause 15, wherein the midsole base layer includes a first material having the first hardness, and wherein the outsole includes an outsole base layer that includes the second outer region including a second material having the third hardness and an outsole insert layer that includes the third outer region including a third material having the third hardness.

Clause 17. The sole structure of Clause 15, wherein the midsole includes a midsole heel band secured to at least one of the midsole base layer or the midsole perimeter portion and a midsole forefoot band secured to at least one of the midsole base layer or the midsole perimeter portion.

Clause 18. The sole structure of Clause 17, wherein the midsole base layer includes at least one heel region flange having at least one heel region embossed portion, wherein the midsole perimeter portion includes at least one heel region passage sized for receiving the at least one heel region embossed portion.

Clause 19. The sole structure of Clause 18, wherein the midsole heel band includes at least one heel region opening, wherein the at least one heel region embossed portion extends through the at least one heel region passage and into the at least one heel region opening.

Clause 20. The sole structure of Clause 19, wherein the midsole base layer includes at least one forefoot region flange having at least one forefoot region embossed portion, wherein the midsole perimeter portion includes at least one forefoot region passage sized for receiving the at least one forefoot region embossed portion.

Clause 21. The sole structure of Clause 20, wherein the midsole forefoot band includes at least one forefoot region opening, wherein the at least one forefoot region embossed portion extends through the at least one forefoot region passage and into the at least one forefoot region opening.

Clause 22. A sole structure of an article of footwear, the sole structure comprising (i) an innermost outer region at least partially disposed along a longitudinal axis of the sole structure and having a first hardness, (ii) an outermost outer region including a first outermost portion disposed along a lateral side of the sole structure, and a second outermost portion disposed along a medial side of the sole structure, the outermost outer region having a second hardness that is greater than the first hardness, and (iii) an intermediate outer region including a first intermediate portion disposed between the innermost outer region and the first outermost portion, and a second intermediate outer portion disposed between the innermost outer region and the second outermost portion, the intermediate outer region having a third hardness that is greater than the first hardness and less than the second hardness.

Clause 23. The sole structure of Clause 22, wherein the innermost outer region, the outermost outer region and the intermediate outer region are each formed from a different material.

Clause 24. The sole structure of Clause 22, wherein the innermost outer region includes a first material having the first hardness, wherein the outermost outer region includes a second material having the second hardness, and wherein the intermediate outer region includes a third material having the third hardness.

Clause 25. The sole structure of Clause 22, wherein the first hardness includes a Shore A durometer value greater than 48 and less than 54.

Clause 26. The sole structure of Clause 22, wherein the second hardness includes a Shore A durometer value greater than 85 and less than 91.

Clause 27. The sole structure of Clause 22, wherein the third hardness includes a Shore A durometer value greater than 64 and less than 70.

Clause 28. The sole structure of Clause 22, wherein the sole structure includes an outsole including the intermediate outer region and the outermost outer region and defining a first passage and a midsole including a first outer pad disposed within the first passage, the first outer pad including the innermost outer region.

Clause 29. The sole structure of Clause 28, wherein the first passage is disposed within a heel region of the sole structure and wherein the sole structure further includes a second passage disposed within one of a forefoot region or a midfoot region of the sole structure, and wherein the midsole includes a second outer pad disposed within the second passage.

Clause 30. The sole structure of Clause 28, wherein the outsole includes an outsole base layer including the outermost outer region and at least one opening and an outsole insert layer including the intermediate outer region and at least one opening, wherein the at least one opening of the outsole base layer is aligned with the at least one opening of the outsole insert layer.

Clause 31. The sole structure of Clause 30, wherein the midsole includes a first material having the first hardness, wherein the outsole base layer includes a second material having the second hardness, and wherein the outsole insert layer includes a third material having the third hardness.

Clause 32. The sole structure of Clause 30, wherein the outsole insert layer includes an intermediate portion, a ring portion extending from the intermediate portion and defining the first passage, and a forked portion extending from the intermediate portion and defining a second passage.

Clause 33. The sole structure of Clause 32, wherein the forked portion includes a lateral prong and a medial prong.

Clause 34. The sole structure of Clause 30, wherein the midsole includes a midsole base layer including an upper surface and a lower surface and a midsole perimeter portion connected to the upper surface of the midsole base layer, wherein the first outer pad extends from the lower surface of the midsole base layer and through the first passage of the outsole.

Clause 35. The sole structure of Clause 34, wherein the midsole base layer includes a first material having the first hardness, and wherein the outsole includes an outsole base layer that includes the outermost outer region including a second material having the second hardness and an outsole insert layer that includes the intermediate outer region including a third material having the third hardness.

Clause 36. The sole structure of Clause 34, wherein the midsole includes a midsole heel band secured to at least one of the midsole base layer or the midsole perimeter portion and a midsole forefoot band secured to at least one of the midsole base layer or the midsole perimeter portion.

Clause 37. The sole structure of Clause 36, wherein the midsole base layer includes at least one heel region flange having at least one heel region embossed portion, wherein the midsole perimeter portion includes at least one heel region passage sized for receiving the at least one heel region embossed portion.

Clause 38. The sole structure of Clause 37, wherein the midsole heel band includes at least one heel region opening, wherein the at least one heel region embossed portion extends through the at least one heel region passage and into the at least one heel region opening.

Clause 39. The sole structure of Clause 38, wherein the midsole base layer includes at least one forefoot region flange having at least one forefoot region embossed portion, wherein the midsole perimeter portion includes at least one forefoot region passage sized for receiving the at least one forefoot region embossed portion.

Clause 40. The sole structure of Clause 39, wherein the midsole forefoot band includes at least one forefoot region opening, wherein the at least one forefoot region embossed portion extends through the at least one forefoot region passage and into the at least one forefoot region opening.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sole structure of an article of footwear, the sole structure comprising:

a first outer region at least partially disposed a first distance from a longitudinal axis and having a first hardness;

a second outer region at least partially disposed a second distance from the longitudinal axis and having a second hardness that is greater than the first hardness; and a third outer region at least partially disposed between the first outer region and the second outer region a third distance from the longitudinal axis and having a third hardness that is greater than the first hardness and less than the second hardness, wherein the second distance is greater than the first distance, and the third distance is greater than the first distance and less than the second distance, wherein the first distance, the second distance, and the third distance extend away from the longitudinal axis of the sole structure to an outermost periphery of the first outer region, the second outer region, and the third outer region, respectively, wherein the outermost peripheries of the first outer region, the second outer region, and the third outer region are disposed on a medial side or a lateral side of the sole structure, and wherein the sole structure includes:

an outsole including the second outer region and the third outer region and defining a first passage; and a midsole including a first outer pad disposed within the first passage, the first outer pad including the first outer region, and wherein the outsole includes:

an outsole base layer including the second outer region and at least one opening; and an outsole insert layer including the third outer region and at least one opening, wherein the at least one opening of the outsole base layer is aligned with the at least one opening of the outsole insert layer, and wherein the at least one opening is sized for receiving and permitting passage of the first outer pad.

2. The sole structure of claim 1, wherein the first outer region, the second outer region and the third outer region are each formed from a different material.

3. The sole structure of claim 1, wherein the first outer region includes a first material having the first hardness, wherein the second outer region includes a second material having the second hardness, and wherein the third outer region includes a third material having the third hardness.

4. The sole structure of claim 1, wherein the first hardness includes a Shore A durometer value greater than 48 and less than 54.

5. The sole structure of claim 1, wherein the third hardness includes a Shore A durometer value greater than 64 and less than 70.

6. The sole structure of claim 1, wherein the second hardness includes a Shore A durometer value greater than 85 and less than 91.

7. The sole structure of claim 1, wherein the first passage is disposed within a heel region of the sole structure and wherein the sole structure further includes a second passage disposed within one of a forefoot region or a midfoot region of the sole structure, and wherein the midsole includes a second outer pad disposed within the second passage.

8. The sole structure of claim 1, wherein the outsole insert layer includes:

an intermediate portion;

a ring portion extending from the intermediate portion and defining the first passage; and a forked portion extending from the intermediate portion and defining a second passage.

9. The sole structure of claim 8, wherein the forked portion includes a lateral prong and a medial prong.

10. A sole structure of an article of footwear, the sole structure comprising:

an innermost outer region at least partially disposed along a longitudinal axis of the sole structure and having a first hardness;

an outermost outer region including a first outermost portion extending away from the longitudinal axis of the sole structure and being disposed along a lateral side of the sole structure, and a second outermost portion extending away from the longitudinal axis of the sole structure and being disposed along a medial side of the sole structure, the outermost outer region having a second hardness that is greater than the first hardness; and an intermediate outer region including an intermediate portion disposed between the innermost outer region and the first outermost portion, the intermediate outer region having a third hardness that is greater than the first hardness and less than the second hardness, wherein the sole structure includes:

an outsole including the intermediate outer region and the outermost outer region and defining a first passage; and a midsole including a first outer pad disposed within the first passage, the first outer pad including the innermost outer region, and wherein the outsole includes:

an outsole base layer including the outermost outer region and at least one opening; and an outsole insert layer including the intermediate outer region and at least one opening, wherein the at least one opening of the outsole base layer is aligned with the at least one opening of the outsole insert layer, and wherein the at least one opening is sized for receiving and permitting passage of the first outer pad.

11. The sole structure of claim 10, wherein the innermost outer region, the outermost outer region and the intermediate outer region are each formed from a different material.

12. The sole structure of claim 10, wherein the innermost outer region includes a first material having the first hardness, wherein the outermost outer region includes a second material having the second hardness, and wherein the intermediate outer region includes a third material having the third hardness.

13. The sole structure of claim 10, wherein the first hardness includes a Shore A durometer value greater than 48 and less than 54.

14. The sole structure of claim 10, wherein the second hardness includes a Shore A durometer value greater than 85 and less than 91.

15. The sole structure of claim 10, wherein the third hardness includes a Shore A durometer value greater than 64 and less than 70.

16. The sole structure of claim 10, wherein the first passage is disposed within a heel region of the sole structure and wherein the sole structure further includes a second passage disposed within one of a forefoot region or a midfoot region of the sole structure, and wherein the midsole includes a second outer pad disposed within the second passage.

17. The sole structure of claim 10, wherein the midsole includes a first material having the first hardness, wherein the outsole base layer includes a second material having the second hardness, and wherein the outsole insert layer includes a third material having the third hardness.

18. The sole structure of claim 10, wherein the midsole includes:

a midsole base layer including an upper surface and a lower surface; and a midsole perimeter portion connected to the upper surface of the midsole base layer, wherein the first outer pad extends from the lower surface of the midsole base layer and through the first passage of the outsole.

19. The sole structure of claim 18, wherein the midsole base layer includes a first material having the first hardness, and wherein the outsole includes:

an outsole base layer that includes the outermost outer region including a second material having the second hardness; and an outsole insert layer that includes the intermediate outer region including a third material having the third hardness.

* * * * *